US007637438B2

(12) United States Patent
Schwiede et al.

(10) Patent No.: US 7,637,438 B2
(45) Date of Patent: Dec. 29, 2009

(54) NON-POSITIVE FIT ELASTIC RAIL CONNECTION FOR TRACK SYSTEMS

(75) Inventors: Karl-Heinz Schwiede, Kreuzlingen (CH); Frank Meyer, Stockach-Wahlwies (DE)

(73) Assignee: Schwihag AG, Tagerwilen (CH)

( * ) Notice: Subject to any disclaimer, the term of this patent is extended or adjusted under 35 U.S.C. 154(b) by 392 days.

(21) Appl. No.: 11/792,754

(22) PCT Filed: Dec. 9, 2005

(86) PCT No.: PCT/EP2005/013211

§ 371 (c)(1),
(2), (4) Date: Jun. 7, 2007

(87) PCT Pub. No.: WO2006/061234

PCT Pub. Date: Jun. 15, 2006

(65) Prior Publication Data

US 2008/0105758 A1 May 8, 2008

(30) Foreign Application Priority Data

Dec. 9, 2004 (DE) ..... 10 2004 059 536
Oct. 12, 2005 (DE) ..... 10 2005 048 829

(51) Int. Cl.
*E01B 9/00* (2006.01)

(52) U.S. Cl. ..... 238/349; 238/351

(58) Field of Classification Search ..... 238/310, 238/381, 349, 351, 352
See application file for complete search history.

(56) References Cited

U.S. PATENT DOCUMENTS 2,980,336 A * 4/1961 Doll ..... 238/349
(Continued)

FOREIGN PATENT DOCUMENTS

DE 33 34119 A1 4/1985

*Primary Examiner*—S. Joseph Morano
*Assistant Examiner*—Jason C Smith
(74) *Attorney, Agent, or Firm*—Andrew Wilford

(57) ABSTRACT

The invention relates to a rail fastener for track systems, comprising a tensioning element (1) made of an elastic material, in particular hardened spring steel that in the assembled state is fixed in place between a retaining plate (3) provided on a sleeper (2) and a fastening anchor (4) such that the tensioning element exerts a retention force on the foot (5) of a rail (6) in order to hold the rail (6) in position, the tensioning element (1) being symmetrically aligned with respect to a vertically oriented plane of symmetry (7) that is perpendicular to the longitudinal axis (8) of the rail (6). According to the invention, the tensioning element (1) has two torsion legs (1*a*' and 1*a*"), preferably extending essentially in parallel, in order to achieve stepped overload protection. The two torsion legs (1*a*' and 1*a*") are connected to one another on the side facing away from the rail (6) by means of a connecting section (1*b*), and a loop-shaped clamping section (1*d*' and 1*d*") is provided on each end (1*c*' and 1*c*") of the torsion leg (1*a*' and 1*a*") facing the rail (6). In the non-tensioned state of the tensioning element (1) the torsion legs (1*a*' and 1*a*") together with the connecting section (1*b*) lie essentially in a first plane (9), and at least a portion of the loop-shaped clamping sections (1*d*' and 1*d*") lie in a second plane (10). The second plane (10) is rotated about an axis (11) in relation to the first plane (9), the axis extending parallel to the sectional axis of the plane of symmetry (7) containing the first plane (9).

29 Claims, 24 Drawing Sheets

U.S. PATENT DOCUMENTS 3,439,874 A * 4/1969 Meier et al. ..... 238/349
3,724,754 A * 4/1973 Molyneux et al. ..... 238/349
3,876,141 A * 4/1975 French ..... 238/349
4,067,495 A * 1/1978 Qureshi ..... 238/349
4,278,204 A * 7/1981 Miller ..... 239/349
4,634,049 A * 1/1987 Steinfeld et al. ..... 238/84
4,770,343 A * 9/1988 Heim et al. ..... 238/349
4,988,040 A * 1/1991 Keusch ..... 238/349
5,046,907 A * 9/1991 von Lange et al. ..... 411/456
5,096,119 A * 3/1992 Schultheiss et al. ..... 238/349
5,566,882 A * 10/1996 Brown et al. ..... 238/343
5,735,458 A * 4/1998 Brown et al. ..... 238/343
6,702,192 B2 * 3/2004 Igwemezie ..... 238/338
2008/0105758 A1 * 5/2008 Schwiede et al. ..... 238/349
2008/0237363 A1 * 10/2008 Hauschild et al. ..... 238/349
2009/0152369 A1 * 6/2009 Westerhoff et al. ..... 238/349

* cited by examiner

NON-POSITIVE FIT ELASTIC RAIL CONNECTION FOR TRACK SYSTEMS

The invention relates to a friction-fit elastic rail fastener for track systems, comprising a tensioning element made of an elastic material, in particular hardened spring steel, that in the assembled state is fixed in place between a retaining plate provided on a sleeper and a fastening anchor such that the tensioning element exerts a retention force on the rail foot in order to hold the rail in position, and the tensioning element is symmetrically aligned with respect to a vertically oriented plane of symmetry that is perpendicular to the longitudinal axis of the rail.

A generic rail fastener is known from DE 34 00 110 [U.S. Pat. No. 4,770,343]. In the cited document a tensioning element is used that in the assembled state is provided between a retaining plate and a fastening anchor. The tensioning element has two legs designed as torsion elements. The torsion legs have two adjacent parallel spring bar sections that are formed one piece with a loop that forms a bracing section and is curved outward and essentially transversely with respect to the spring bar sections. The two spring bar sections of the torsion legs are connected via the transverse connecting piece. The two outer spring bar sections of the torsion legs each have a U-shaped bend, provided at a distance behind the transverse connecting piece that at its free end section is supported on the transverse connecting piece, whereas anchor parts for the rail fastener have two support flanges for the torsion legs of the tensioning element, projecting toward opposite sides, adjacent to a center bar and respectively provided at a distance above stop bevels for the bracing sections located next to the rail foot.

A rail fastener of the above-described type is known from DE 39 18 091 [U.S. Pat. No. 5,096,119] in which sections of the outer legs of the epsilon-shaped tensioning elements widen toward the rail foot with an increase in distance between the inner legs. The mutually aligned free ends of the tensioning element end outside the inner legs. The tensioning element is also designed such that in the assembled position a center bar comes to rest a small distance above the rail foot, and in the preassembled position the inner side of the center bar contacts the shaft of the sleeper screw.

In one of the previously known embodiments, although the tensioning element fulfills its function, namely, to securely hold the rail on the sleeper, the tensioning element is relatively large and complicated in design. This entails a correspondingly high level of manufacturing complexity that increases the production costs for the tensioning elements.

In addition, the previously known tensioning elements do not adequately address the problem that the rail may tilt when unusually high forces impinge thereon. The torsion legs of the tensioning element and the sleeper screws may be highly stressed, i.e. overtightened or overloaded, when the rail tilts. It is therefore desirable to design the rail fastener in such a way that precautions are taken, and also that overloading of the tensioning element and of the sleeper screws is prevented even during tilting.

In one of the previously known embodiments, the tensioning torque is indirectly produced only by tightening the sleeper screws or hook screws. The tensioning force of the tensioning element also acts on the pretensioning force of the sleeper screw, thereby also subjecting the screw to load. In addition, the tensioning element can be assembled only by use of a sleeper screw or hook screw. It is desirable to achieve a universal assembly of the tensioning element, i.e. with or without screws, and, if necessary, without affecting the pretensioning force for the screw.

The object of the invention, therefore, is to refine a rail fastener of the generic type such that the above-referenced disadvantages are avoided, that in particular a simple geometric design of the tensioning element is possible, and that the associated manufacturing costs remain low. A further aim is to provide a reliable two-stage overload protection so that the tensioning element is not damaged even when occasional, unusually high forces arise. A further aim is to provide a possibility for assembly that is universal and, if necessary, independent from the screw pretensioning.

Achievement of this object according to the invention is characterized in that the tensioning element has two preferably parallel torsion legs that in the assembled state are at least substantially provided between the retaining plate and the fastening anchor, and the two torsion legs are connected to one another on the side facing away from the rail by means of a connecting section. In addition, a loop-shaped clamping section is provided on each end of the torsion leg facing the rail, and adjacent the torsion legs the clamping section first extends essentially perpendicular to the plane, and then extends in a looped manner until the ends of the clamping section reach the vicinity of the ends of the torsion legs, where they form a support surface on the rail foot. Furthermore, in the non-tensioned state of the tensioning element the torsion legs together with the connecting section lie essentially in a first plane, and at least a portion of the loop-shaped clamping sections lie in a second plane, whereby the second plane is rotated about an axis in relation to the first plane, the axis extending parallel to the sectional axis of the plane of symmetry containing the first plane.

In the assembled state of the tensioning element, the second plane preferably is substantially congruent with the first plane.

Under normal load on the rail, in the assembled state the loop-shaped clamping sections of the tensioning element preferably contact the rail foot. However, the ends of the clamping section in the assembled state may also engage in recesses provided for same in the retaining plate. In this manner it is possible for the end-face ends of the clamping sections to lock in the recesses for horizontal stabilization in the final assembled position. The recesses in the retaining plate may also have locking projections or catches that enable the ends of the clamping section to engage with the retaining plate.

The loop-shaped clamping sections may also first extend from the end of the torsion legs, essentially perpendicular to the plane of symmetry, and then extend in the direction away from the rail in order to return back to the rail in a curved progression. In this case, the loop-shaped clamping sections preferably have an S-shaped curve, at least in places. This design provides a compact structure of the fastening system, as discussed further below.

In their portions facing the rail as viewed from above, the loop-shaped clamping sections preferably each have an essentially circular or oval shape. Connection transitions between the individual functional zones are provided with large radii or radius transitions to ensure optimal tension curves in the material of the tensioning element. The individual radii or radius transitions along the curve of the tensioning element may have different sizes.

The loop-shaped clamping sections adjacent the torsion is legs may first extend essentially perpendicular from the plane of symmetry.

The angle between the above-referenced planes, i.e. between the first plane and the second plane, is preferably between 5° and 30° in the non-tensioned state of the tensioning element.

The ends of the loop-shaped clamping sections may be designed as straight sections. These straight sections preferably extend parallel to each other.

The ends of the loop-shaped clamping sections, in particular the straight sections, may have a cutout that is designed as a support surface on the corner radius of the rail foot. This allows defined and secure contact on the rail foot.

To accommodate an overload, each loop-shaped clamping section may have a first contact surface in the lateral region of the clamping section for contacting the rail foot, the first contact surface likewise contacting the rail foot when the rail tilts in the event of high horizontal forces on the rail head (first overload case), but with a greatly reduced lever arm. In addition, each loop-shaped clamping section may have a second contact surface for contacting the fastening anchor, and in a second, more intense overload case that exceeds the first overload case for the forces acting on the rail, the second contact surface contacts the fastening anchor.

The retaining plate may be integrated into a rail-bed plate.

The retaining plate and the fastening anchor may have a two-piece design. The retaining plate and the fastening anchor may be connected or held together by means of a hook screw.

The fastening anchor may be plate-shaped and fixed in placed by a screw.

The retaining plate and the fastening anchor may also have a one-piece design.

On its lower face, in its lateral end regions facing the rail, the fastening anchor may have contact surfaces for the loop-shaped clamping sections. On its lower face the fastening anchor in its lateral end regions facing away from the rail may also have a first channeled locking depression in each case for locking the tensioning element in a preassembled position. On its lower face the fastening anchor may also have a second channeled locking depression in its lateral end regions facing away from the rail for locking the tensioning element in a neutral position. Finally, on its lower face the fastening anchor may have two channeled contact surfaces for supporting the torsion legs of the tensioning element in the final assembled state.

The fastening anchor may also be formed by the sleeper screw or by a washer connected thereto.

The retaining plate may have two curved depressions, extending perpendicular to the longitudinal axis of the rail, for guiding the tensioning element during installation thereof. The retaining plate may have two contact surfaces for contacting the tensioning element in its assembled state. Furthermore, on its lower face the retaining plate may have a projection, extending in the direction of the longitudinal axis of the rail, for engaging with a corresponding recess in the sleeper.

The tensioning element may be economically produced by use of the proposed design. The tensioning element is relatively compact, so that the proposed rail fastener may be used for a number of applications.

In addition, two-stage overload protection of the rail fastener is provided in the event of overload, thereby reliably preventing excessive tilting of the rail and avoiding plastic deformation of the clamp.

Illustrated embodiments of the invention are shown in the drawings that show the following:

FIG. 44 and

Figure 40:
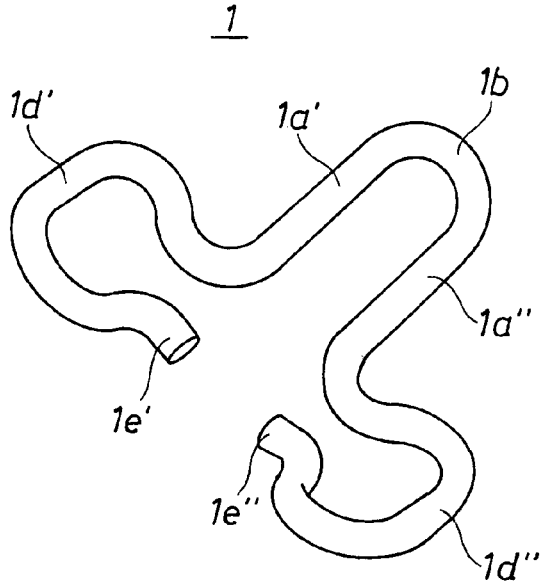
FIG. 40 shows a perspective view of a further alternative design of the tensioning element in a view from above.
Figure 41:
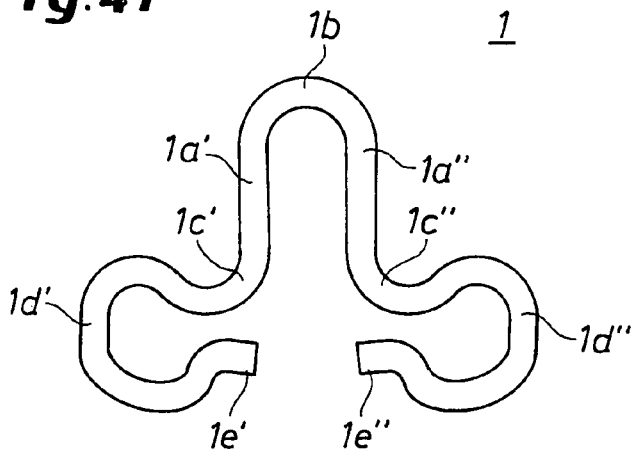
FIG. 41 shows a top view of the tensioning element according to FIG. 40.
Figure 42:
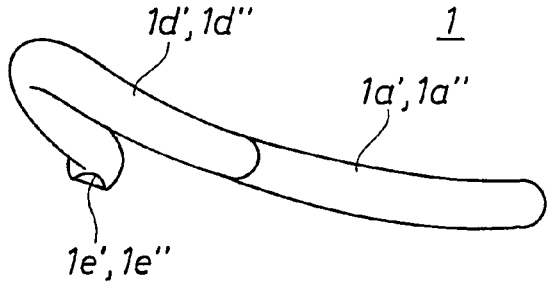
FIG. 42 shows a side view of the tensioning element according to FIG. 40.
Figure 43:
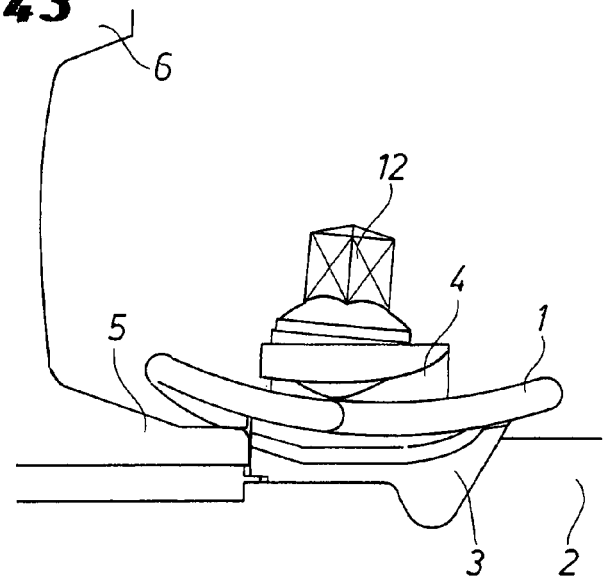
FIG. 43 shows a side view of the rail fastener together with the tensioning element according to FIGS. 40 through 42, in the final assembled position.
Figure 44:
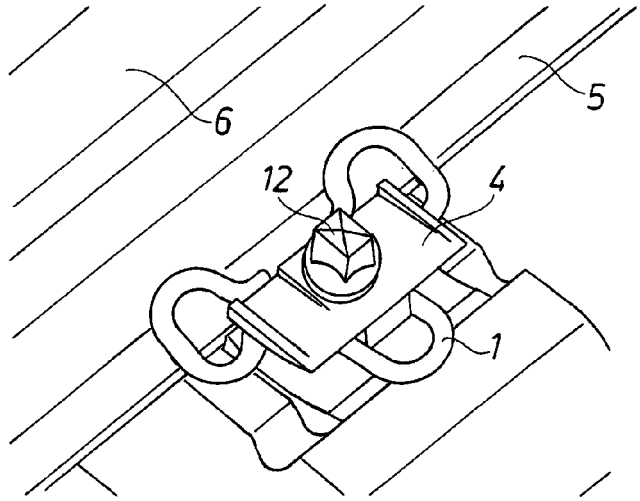
Figure 45:
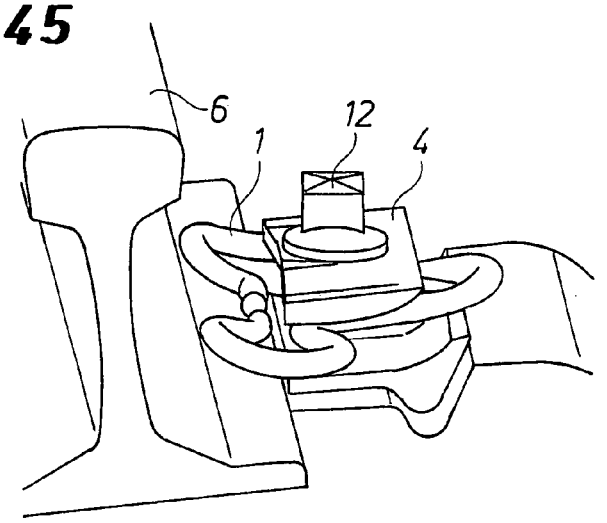
Figure 46:
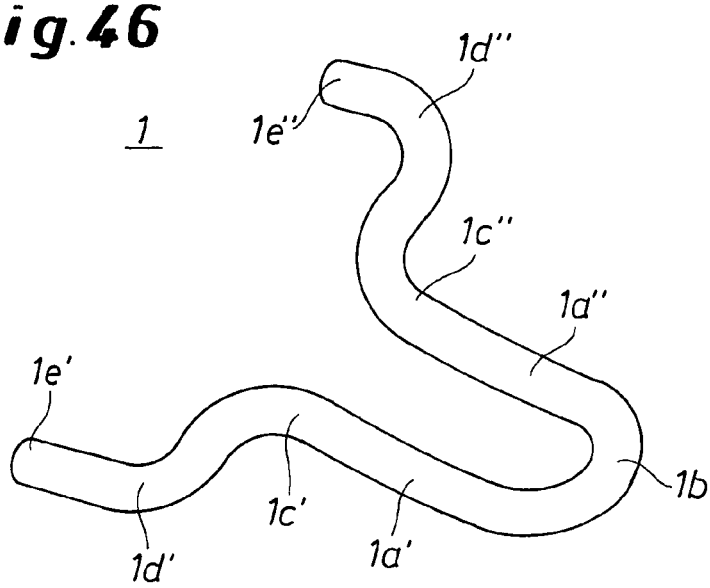
Figure 47:
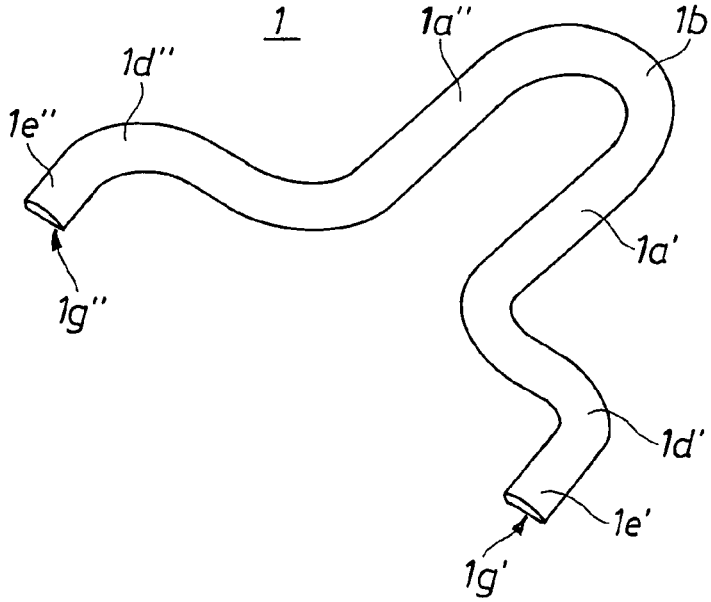
Figure 48:
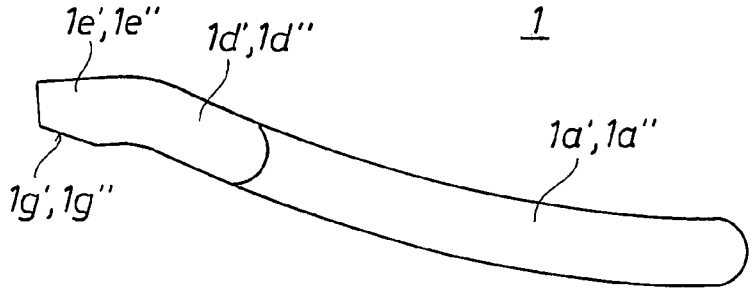
Figure 49:
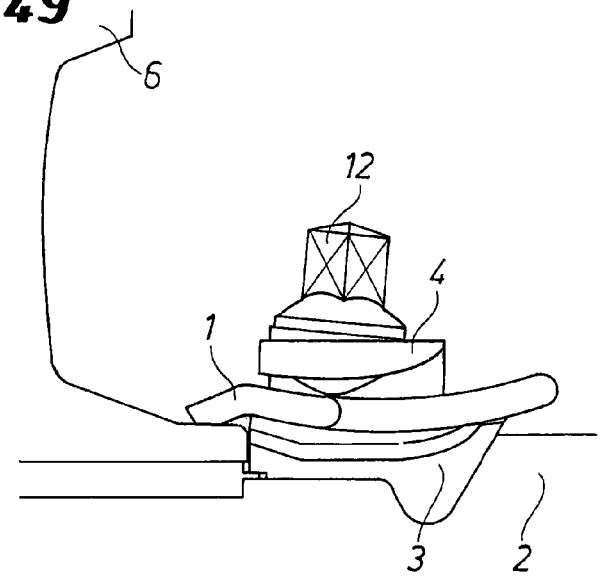
Figure 50:
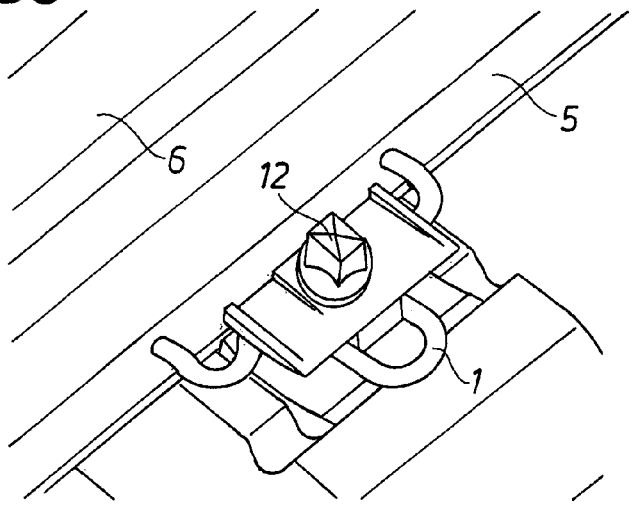
Figure 51:
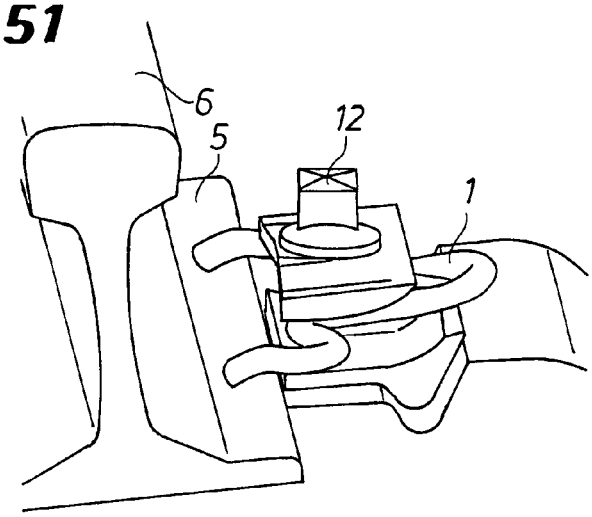

FIG. 45 show the perspective illustration of the rail fastener together with the tensioning element according to FIGS. 40 through 42 from two different viewing directions, in the final assembled position;

FIG. 46 shows a perspective view of a further alternative design of the tensioning element in a view from above;

FIG. 47 shows a perspective view of the tensioning element according to FIG. 46 from another viewing direction;

FIG. 48 shows a side view of the tensioning element according to FIG. 46 or 47;

FIG. 49 shows a side view of the rail fastener together with the tensioning element according to FIGS. 46 through 48, in the final assembled position; and FIG. 50 and FIG. 51 show the perspective illustration of the rail fastener together with the tensioning element according to FIGS. 46 through 48 from two different viewing directions, in the final assembled position.

FIGS. 1 through 4 show the basic structure of a friction-fit elastic rail fastener for a track system. The rail 6 must be fastened to a sleeper 2 or a rail-bed plate (see FIG. 23). For this purpose, the sleeper 2 is formed with a recess 24 whose shape corresponds to a projection of a retaining plate 3 mounted on the sleeper 2. The recess 24 may correspond to the shape of a known angled guide plate, or may have another design. A plate-shaped fastening anchor 4 is fixed to the retaining plate 3 and the sleeper 2 by means of a sleeper screw 12. A tensioning element 1 is provided between the fastening anchor 4 and the retaining plate 3 and in its assembled state exerts a pressure force on the rail foot 5 and thus holds the rail 6 in the intended position.

Figure 1:
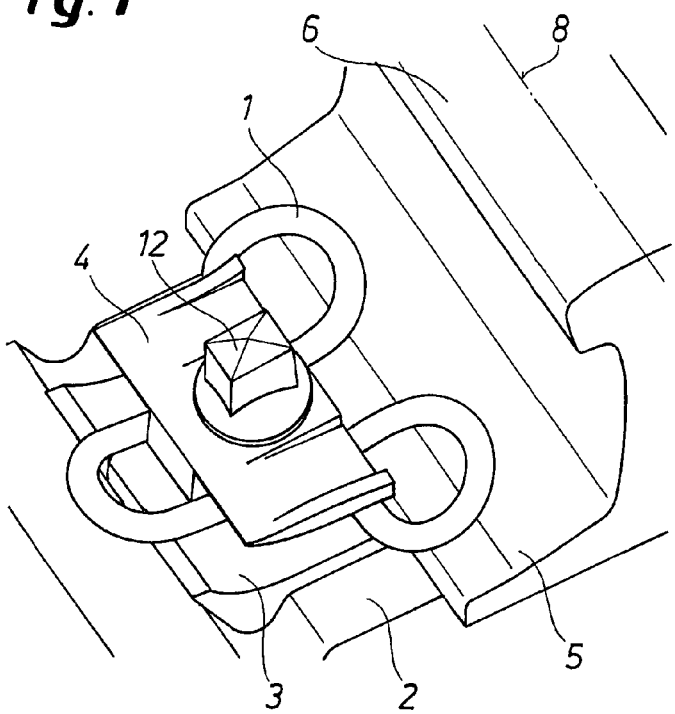
FIG. 1 shows a perspective view of a friction-fit elastic fastener for a rail in a track system.
Figure 2:
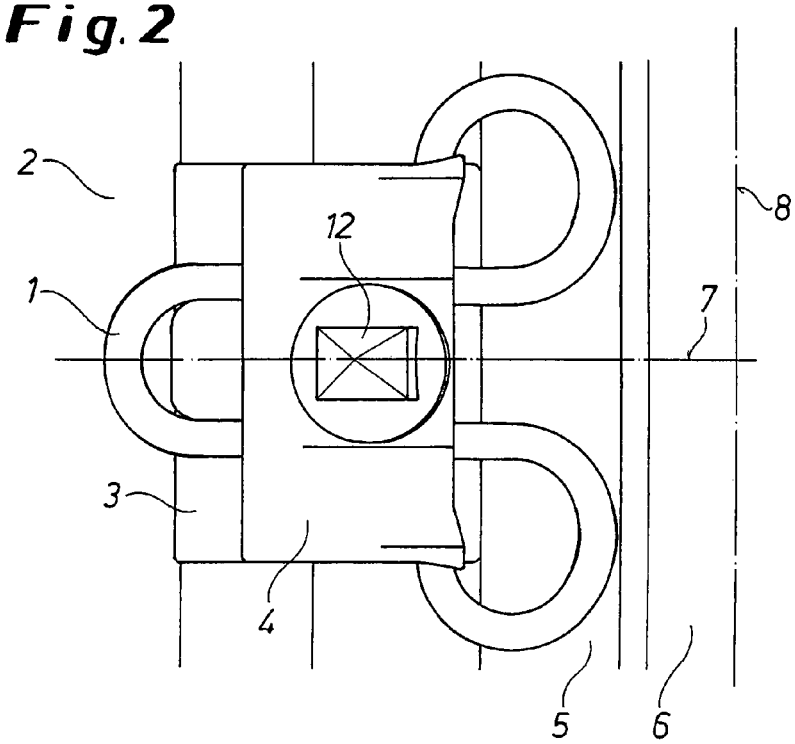
FIG. 2 shows a top view of the system according to FIG. 1.
Figure 3:
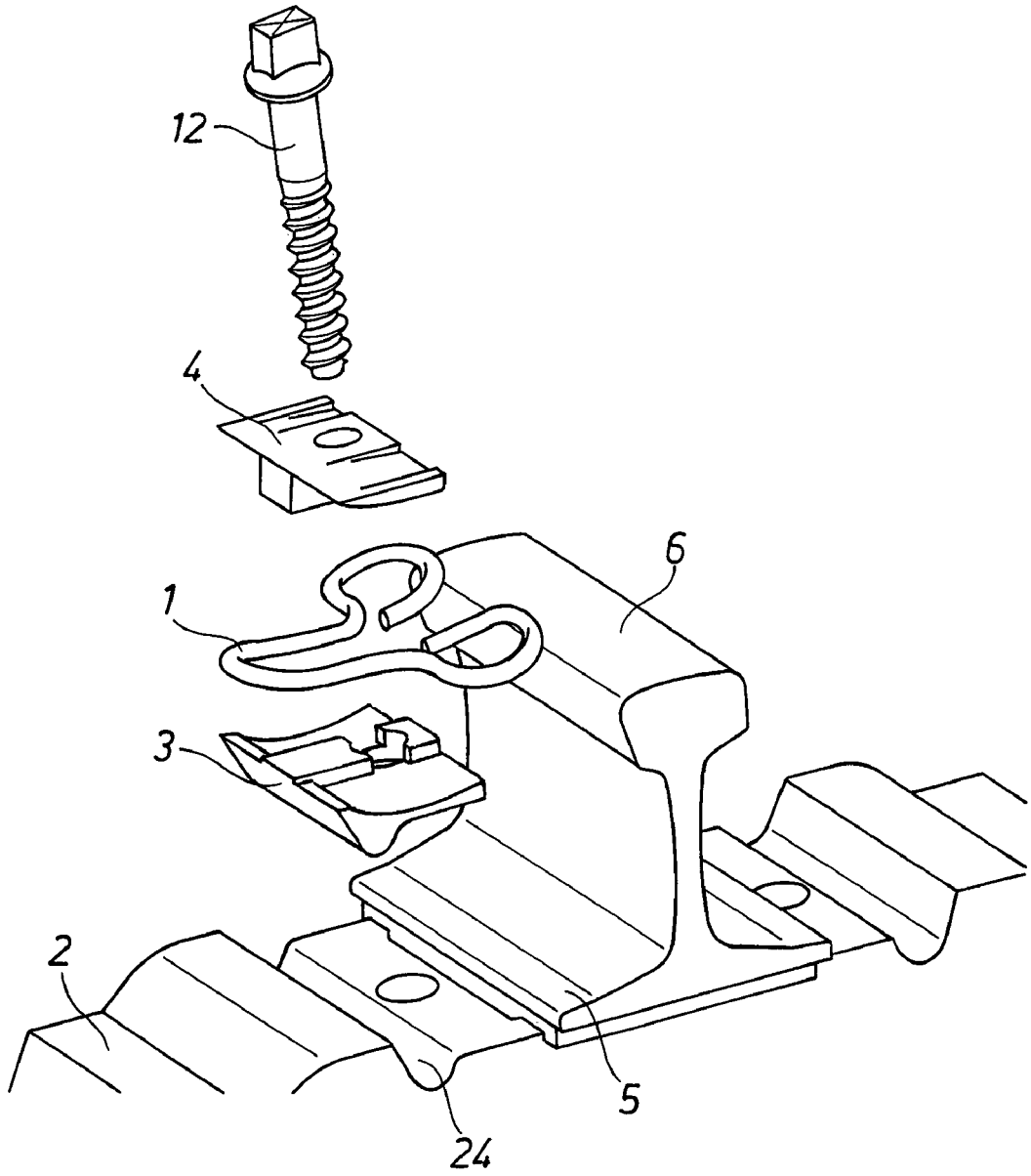
FIG. 3 shows a perspective view of an exploded illustration of the rail fastener according to FIG. 1.
Figure 4:
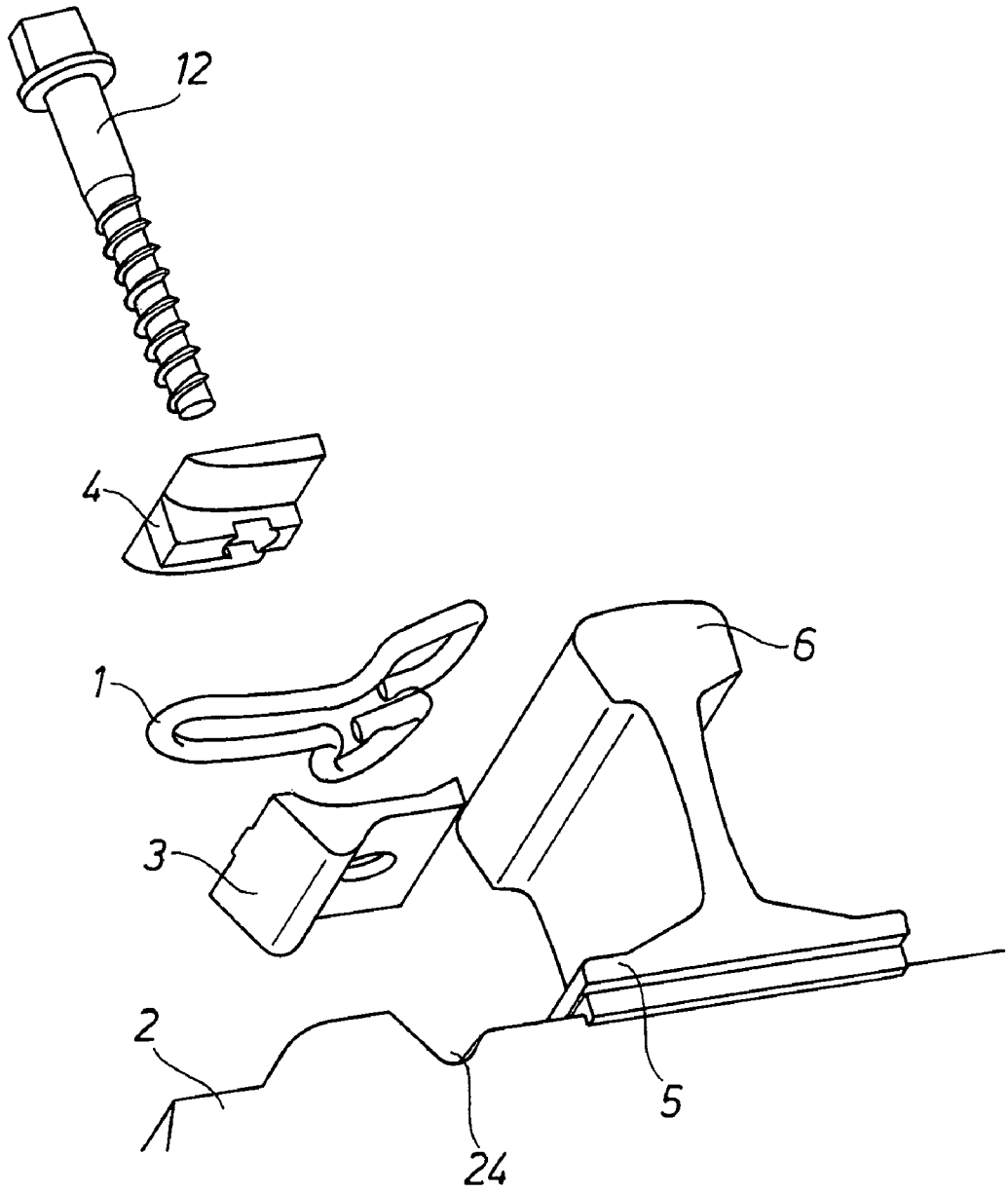
FIG. 4 shows the exploded illustration according to FIG. 3 in a view from below.

As shown in FIG. 2, the tensioning element 1 has a symmetrical design with a vertical axis of symmetry 7 extending perpendicular to the longitudinal axis 8 of the rail 6.

The specific design of the tensioning element 1 is shown in FIGS. 5 through 10.

Figure 5:
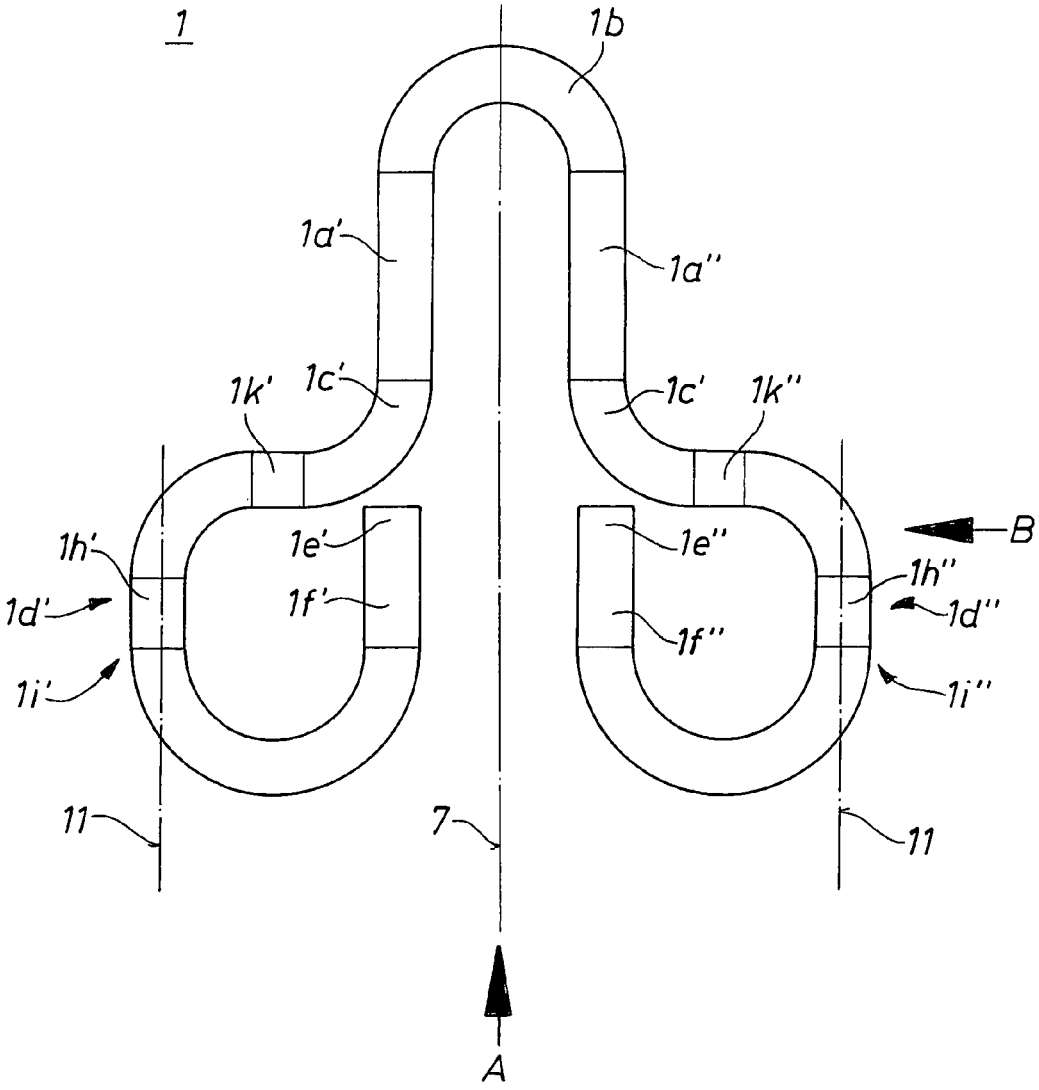
FIG. 5 shows a top view of the non-tensioned tensioning element for the rail fastener.

As shown most clearly in FIG. 5, the tensioning element 1 comprises two torsion legs 1*a*' and 1*a*" that are symmetrical with respect to the plane of symmetry 7 and parallel to each other. The torsion legs are connected to one another via a connecting section 1*b*. Loop-shaped clamping sections 1*d*' and 1*d*" is provided on the respective ends 1*c*' or 1*c*" of the torsion legs 1*a*, and 1*a*"; i.e. the torsion leg 1*a*' and 1*a*" merges into the clamping section 1*d*' and 1*d*" via a rounded section. The clamping section 1*d*' and 1*d*" each have an essentially circular or oval shape in the top view of the tensioning element 1 (see FIG. 5). The clamping section 1*d*' and 1*d*" extend in a circular configuration until reaching their ends 1*e*' and 1*e*" that come to rest in the vicinity of the ends 1*c*' and 1*c*" of the torsion legs 1*a*' and 1*a*".

Figure 7:
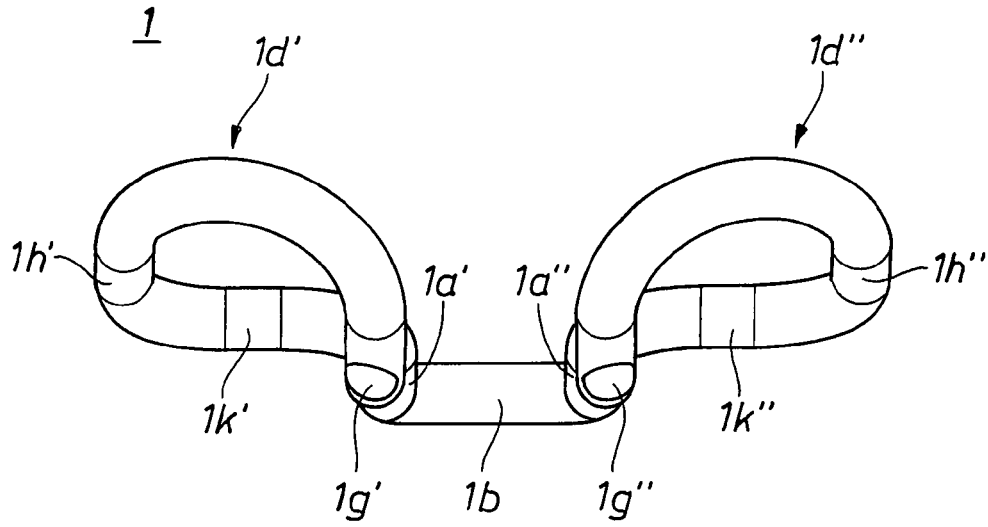
FIG. 7 shows a view corresponding to FIG. 6, from a lower viewing angle.
Figure 8:
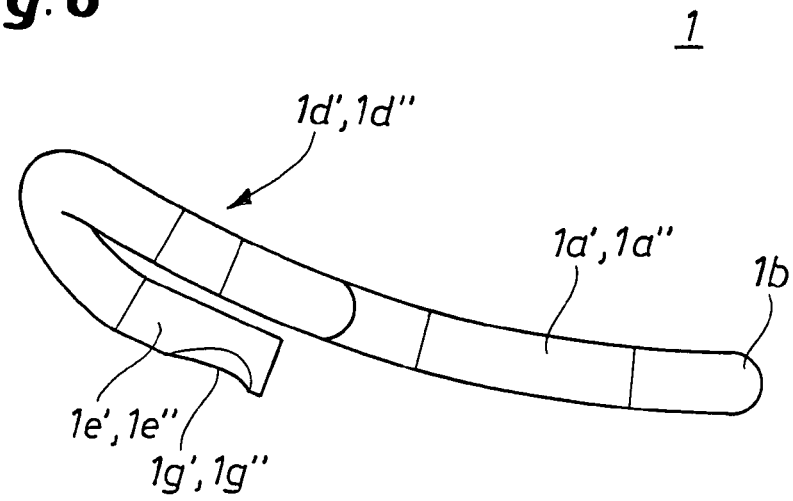
FIG. 8 shows a side view (view B according to FIG. 5) of the tensioning element.
Figure 9:
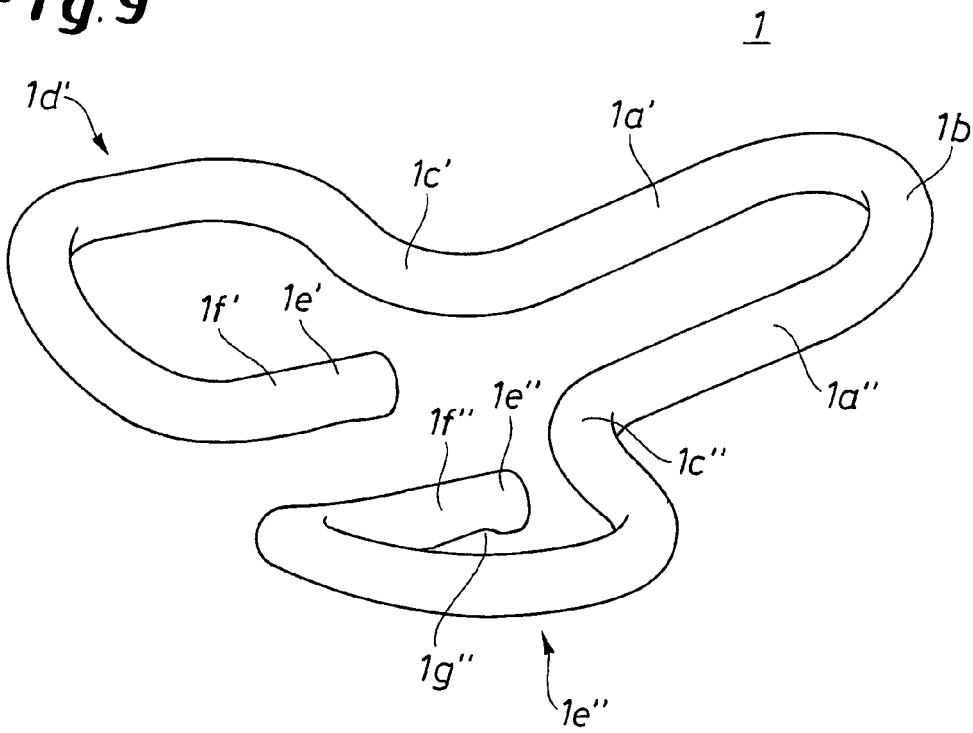
FIG. 9 shows a perspective view of the tensioning element in a view from above.
Figure 10:
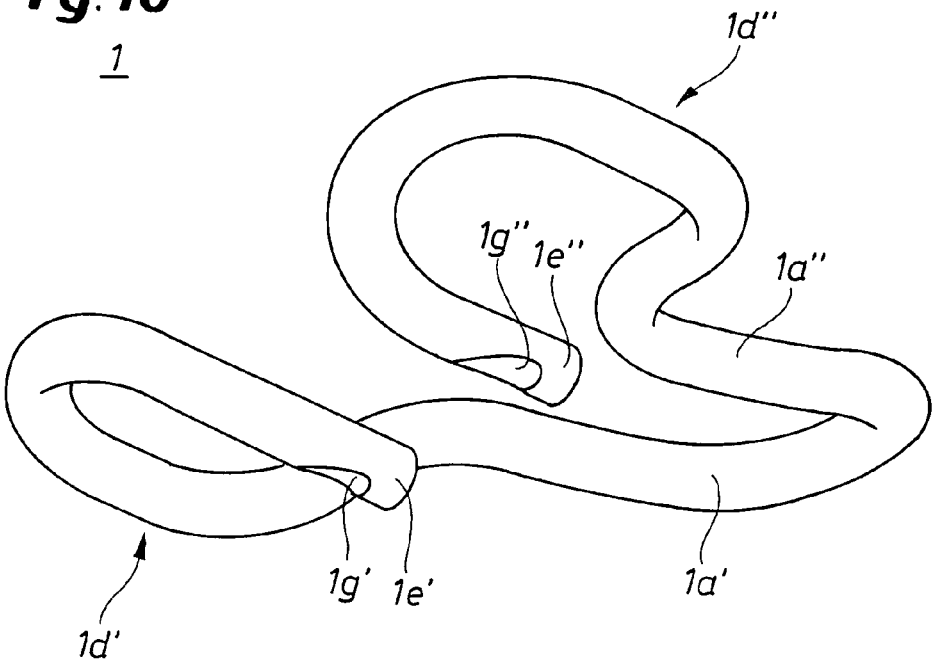
FIG. 10 shows a perspective view of the tensioning element in a view from below.

This end regions 1*e*' and 1*e*" are designed as straight sections 1*f*' and 1*f*", and are provided for pressing on the top side of the rail foot 5 in normal operation. As shown in FIGS. 7, 8, and 10, for this purpose cutouts 1*g*' and 1*g*" are provided in the tensioning element 1, namely, in the straight sections 1*f*' and 1*f*", so that in the region of the straight sections 1*f*' and 1*f*" the tensioning element 1 lies flat (not just in selected locations) on the corner radius of the rail foot 5.

Figure 6:
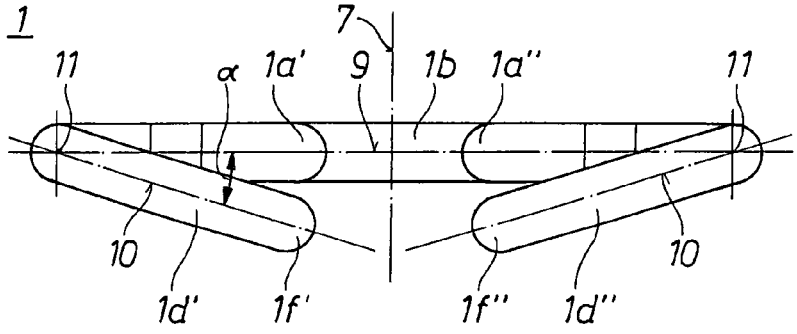
FIG. 6 shows a front view (view A according to FIG. 5) of the tensioning element.

As shown most clearly in FIG. 6, the two torsion legs 1*a*' and 1*a*" together with the connecting section 1*b* lie essentially in a first plane 9. Portions of the clamping sections 1*d*' and 1*d*", however, lie in a second plane 10 that is rotated with respect to the plane 9 about the axis 11 by the angle $\alpha$. The axis 11 is parallel to the sectional axis of the plane of symmetry 7 containing the first plane 9, and in FIG. 6 is thus perpendicular to the plane of the drawing. The angle $\alpha$ is 5° to 30° in the non-tensioned or partially tensioned state.

As a result of this design, after the tensioning element 1 is assembled, it makes defined contact only in the region of the straight sections 1*f*' and 1*f*". The tensioning element 1 otherwise does not contact the rail foot 5 in normal operation.

As shown in FIG. 8, the tensioning-element 1 as a whole may have a slightly curved design to provide optimal cooperation with the retaining plate 3 or with the fastening anchor 4. This figure also clearly shows the manner in which the frontmost portion of the clamping section 1*d*' and 1*d*" is rotated out of the plane of the torsion legs.

The following precautions are taken to prevent damage or overload of the tensioning element 1 in the event of an excessive lateral, horizontal force on the head of the rail 6, i.e. when the rail 6 undergoes a tilting motion about its longitudinal axis 8.

First contact surfaces 1*h*' and 1*h*" are provided on the tensioning element, i.e. in the region of the loop-shaped clamping sections 1*d*' and 1*d*", in lateral regions 1*i*' and 1*i*" of the clamping sections 1*d*' and 1*d*". In the event of extreme tilting of the rail 6, the rail foot 5 also presses on these contact surfaces 1*h*' and 1*h*", thereby increasing the elastic force of the tensioning element 1 on the rail foot 5. Thus, the first stage of an overload protection is provided by the first contact surfaces 1*h*' and 1*h*".

If the tilting motion of the rail 6 should increase even more, second contact surfaces 1*k*' and 1*k*" are provided on the clamping sections 1*d*' and 1*d*" that upon further lifting of the clamping sections 1*d*' and 1*d*" are also lifted and press against contact surfaces 15' and 15" (see FIG. 14) on the fastening anchor 4. This results in high resistance to further tilting of the rail 6 without overtightening and therefore damaging the tensioning element 1.

Figure 11:
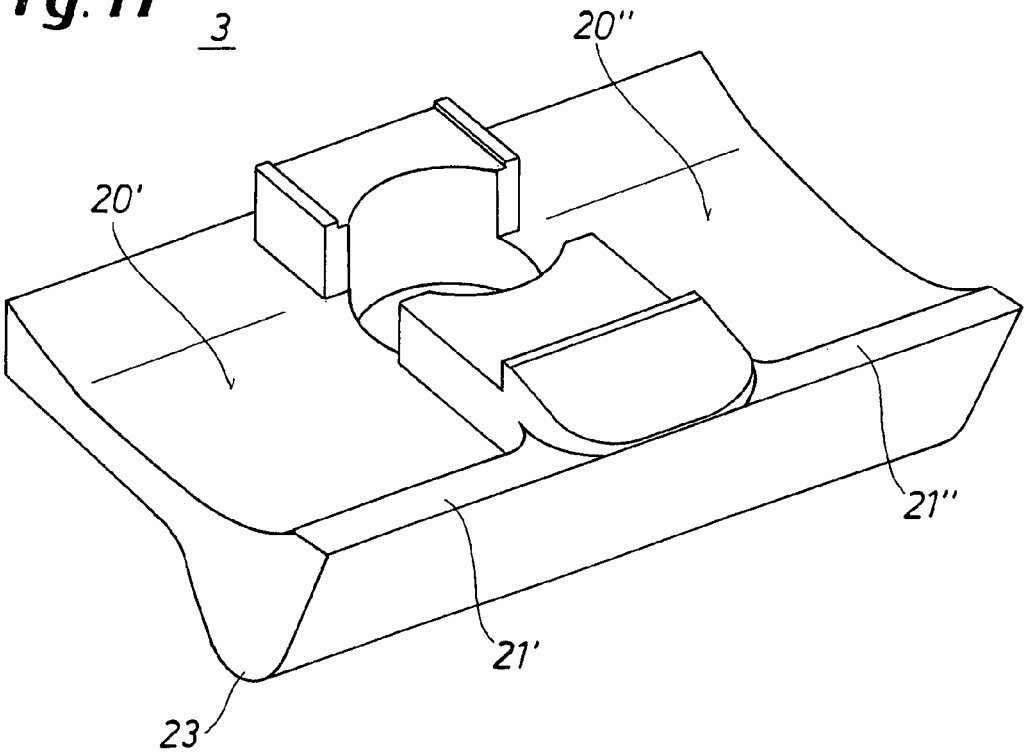
FIG. 11 shows a perspective view of the retaining plate for the rail fastener in a view from above.
Figure 12:
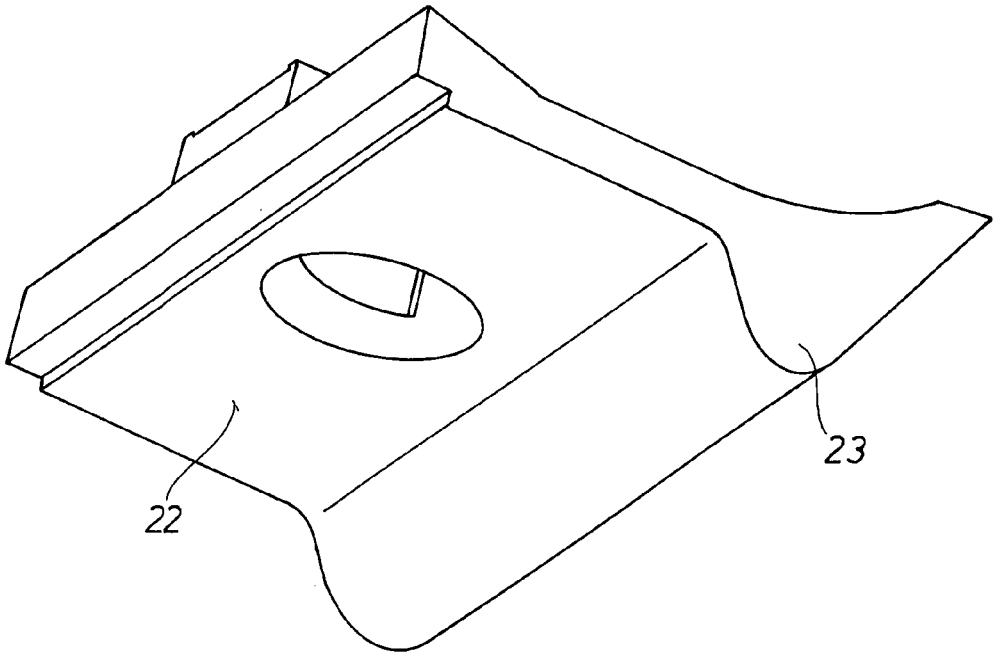
FIG. 12 shows a perspective view of the retaining plate according to FIG. 11 in a view from below.

FIGS. 11 and 12 illustrate one possible approach to the use of a retaining plate 3. On its lower face 22 the retaining plate 3 has a projection 23 whose shape corresponds to that of the recess 24 in the sleeper 2 (see FIGS. 3 and 4). This ensures precise contact of the retaining plate 3 on the sleeper 2. On its, top side the retaining plate 3 has two curved depressions 20' and 20" that facilitate installation of the tensioning element 1 during assembly. In the final assembled state the tensioning element 1 rests on contact surfaces 21' and 21" on the retaining plate 3. The curved or trough-shaped depressions are useful when the tensioning element 1 is installed from the rear using an installation tool; i.e. it is not necessary to detach the fastening anchor 4. The depressions are used to push the tensioning element through from behind without great exertion of force. In the absence of the depressions, the tensioning element would have to be completely compressed to its final tensioned state when pushed through.

Figure 13:
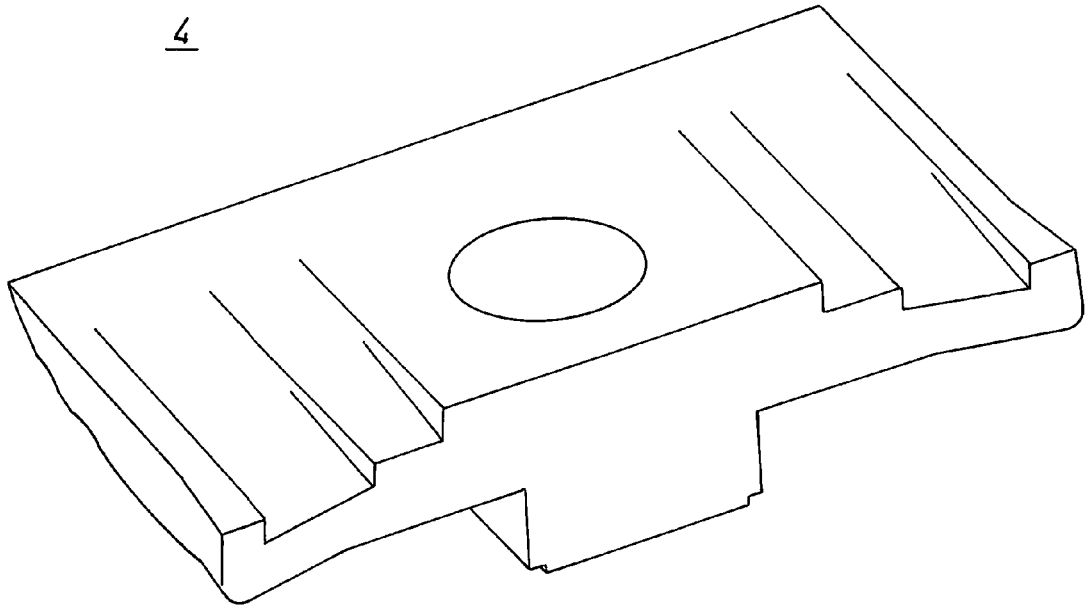
FIG. 13 shows a perspective view of the fastening anchor for the rail fastener in a view from above.
Figure 14:
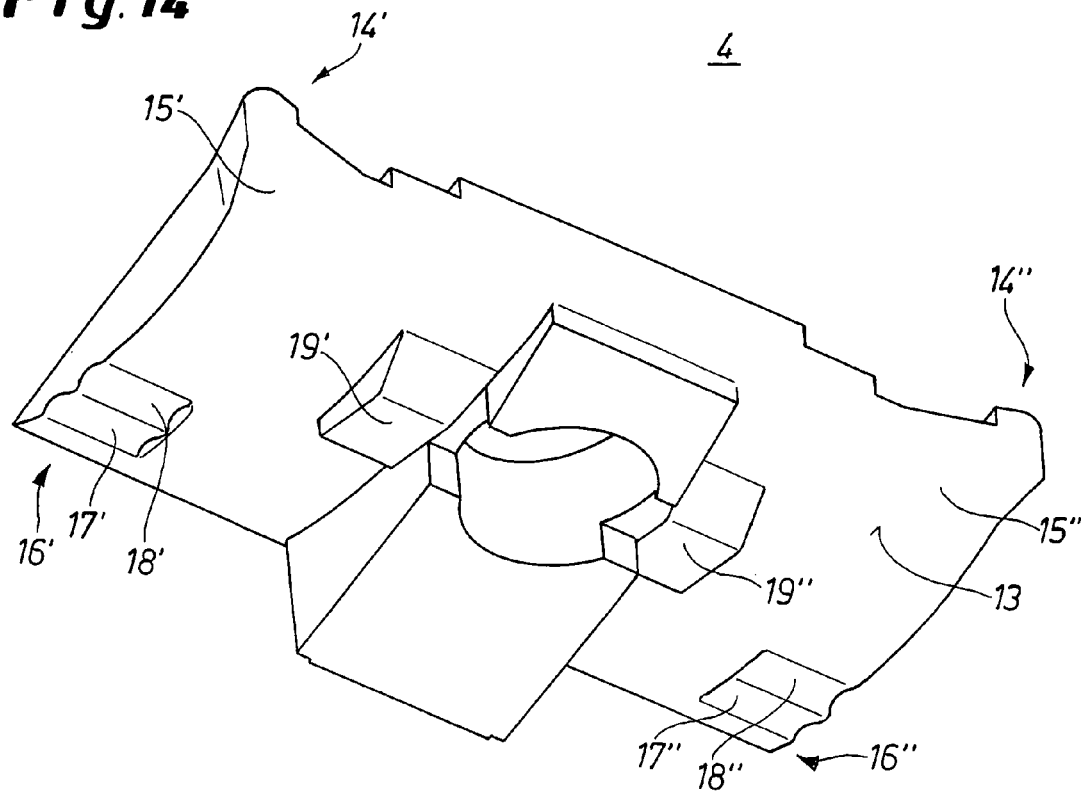
FIG. 14 shows a perspective view of the fastening anchor according to FIG. 13 in a view from below.

The fastening anchor 4 is shown in FIGS. 13 and 14. The lower face 13 of the plate-shaped fastening anchor 4 has various features that facilitate assembly and retention of the tensioning element 1 in the final assembled position. In lateral end regions 14' and 14" of the fastening anchor 4 facing the rail are located the previously mentioned contact surfaces 15' and 15" that in the second overload protection stage are contacted by the clamping sections 1*d'* and 1*d"* at the second contact sections 1*k'* and 1*k"* thereof.

During assembly the tensioning element 1 is first pushed in the direction of the rail until it rests against first channeled locking depressions 17' and 17" that are provided, i.e. integrally molded, in lateral end regions 16' and 16". When the tensioning element 1 is advanced further in the direction of the rail 6, and thus in the direction of the final position of the tensioning element after assembly, the tensioning element 1 comes to rest in second channeled locking depressions 18' and 18". In the final assembled position the tensioning element 1 then makes contact in channeled contact surfaces 19' and 19".

Figure 15:
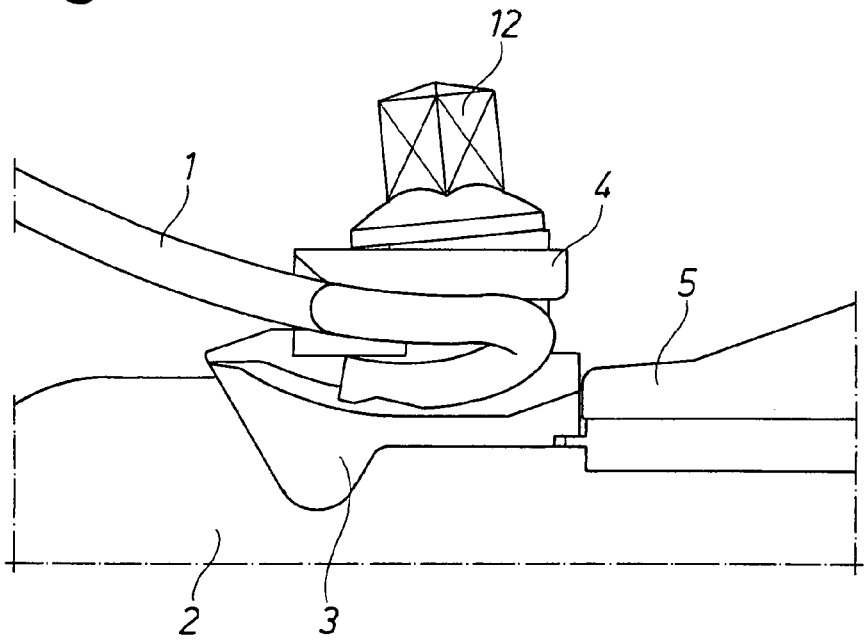
FIG. 15 shows a side view of the rail fastener during a first stage of assembly, namely, in the preassembled stage.

The assembly sequence for the rail fastener is shown in FIGS. 15 through 18:

The first stage of installation in the preassembled position is shown in FIG. 15. The fastening anchor 4 together with the retaining plate 3 is preassembled (on the track or in the sleeper unit) by means of the sleeper screw 12 that has been completely tightened. The tensioning element 1 is first installed by hand into the space between the retaining plate 3 and the fastening anchor 4. By use of an installation tool the tensioning element 1 may then be advanced further in the direction of the rail. This is done until the frontmost regions of the clamping sections 1*d'* and 1*d"* come to rest in the first channeled locking depressions 17' and 17" in the fastening anchor 4.

Figure 16:
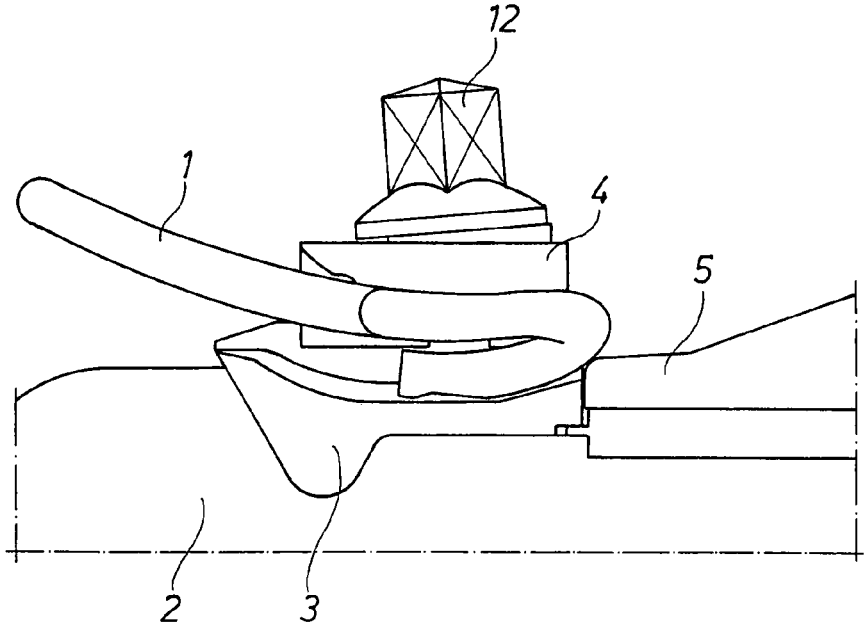
FIG. 16 shows a side view of the rail fastener during a second stage of assembly, namely, in the neutral position.

FIG. 16 shows the second stage of installation, the neutral position. In the neutral position the tensioning element 1 is advanced in the direction of the rail until the frontmost regions of the clamping sections 1*d'* and 1*d"* come to rest in the second channeled locking depressions 18' and 18" in the fastening anchor 4. In this position of the tensioning element 1 the rail is prevented from tilting out during the assembly operation. A small tensioning force is produced by the tensioning element 1.

Figure 17:
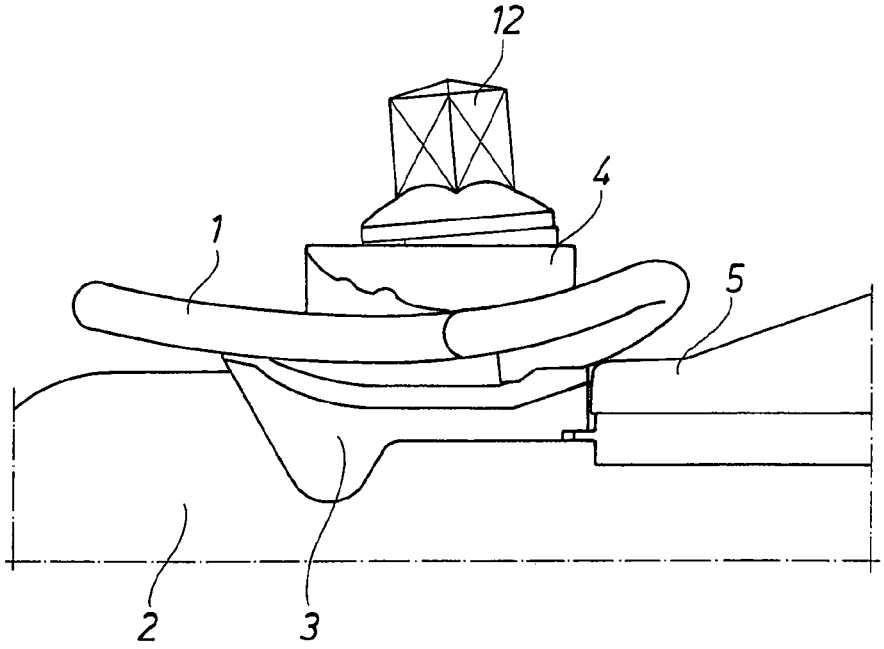
FIG. 17 shows a side view of the rail fastener during a third stage of assembly, namely, in the intermediate stage position.

In the third stage of installation, the intermediate stage as shown in FIG. 17, the tensioning element, 1 has been advanced further in the direction of the rail. This stage represents a deformation of the tensioning element between the neutral position and the final tensioning. In this position a central tensioning force is produced by the tensioning element 1, and the tensioning element is clamped between the retaining plate and the fastening anchor.

Figure 18:
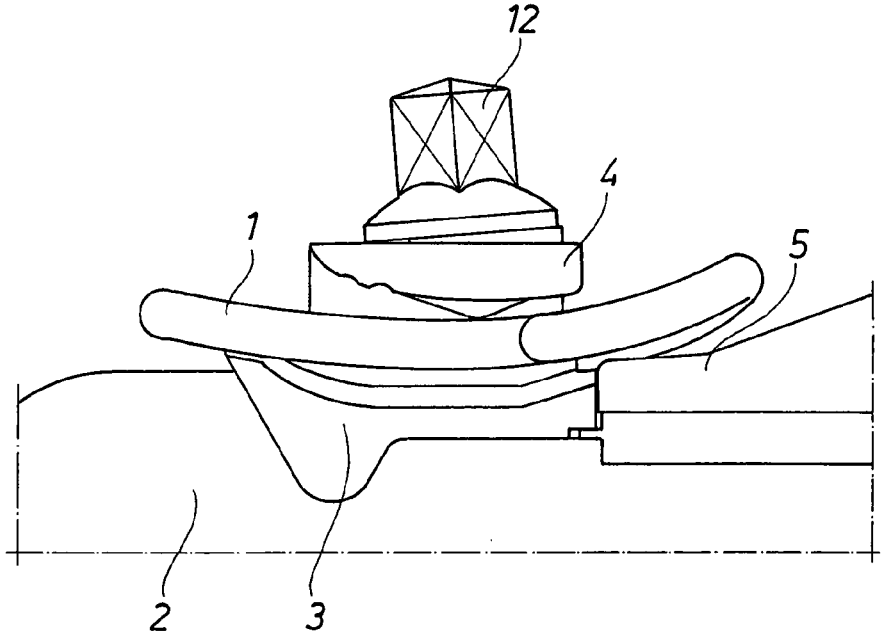
FIG. 18 shows a side view of the rail fastener after assembly is complete.

FIG. 18 shows the fourth stage of installation, the final tensioning. The tensioning element 1 now prevents the rail from tilting during operation. A sufficient final tensioning force is produced, depending on the application. The tensioning element 1 now rests or makes contact with three-regions: In the vicinity of the straight sections 1*f'* and 1*f"* the tensioning element 1 presses on the rail foot 5. At the fastening anchor 4 the tensioning element 1 rests against the channeled contact surfaces 19' and 19". The retaining plate 3 contacts the tensioning element at the contact surfaces 21' and 21".

Figure 19:
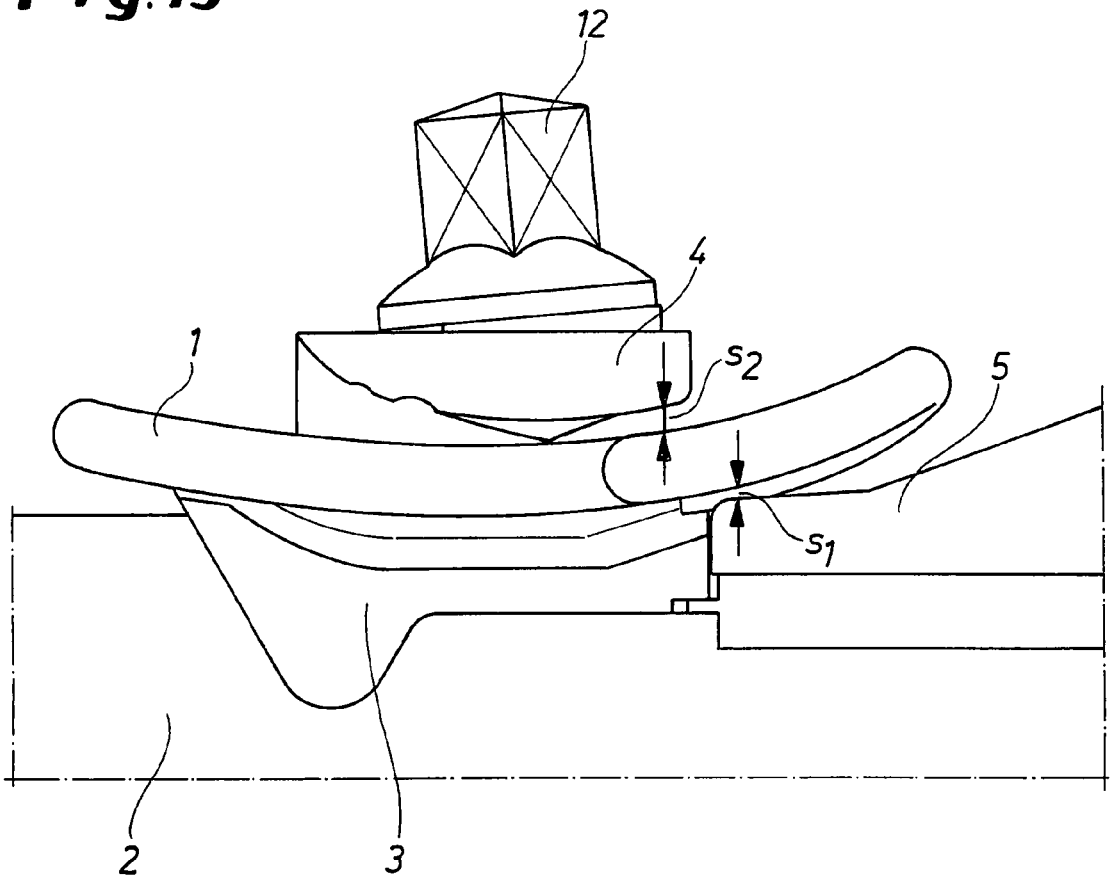
FIG. 19 shows an illustration of the overload protection corresponding to FIG. 18 for preventing the rail from tilting under excessive horizontal forces on the rail head.

The measures for protection against overload of the tensioning element 1 are shown in FIG. 19:

In the first stage of overload protection the first contact surfaces 1*h'* and 1*h"* of the loop-shaped clamping section 1*d'* and 1*d"* of the tensioning element 1 rest on the rail foot 5.

In the first stage of overload protection the first distance, denoted by reference numeral $s_1$ in FIG. 19, approaches zero; i.e. contact occurs between the loop-shaped clamping section and the rail foot.

In the second stage of overload protection the loop-shaped clamping sections 1*d'* and 1*d"* together with the second contact surfaces 1*k'* and 1*k"* are supported on the contact surfaces 15' and 15" of the fastening anchor 4.

In the second stage of overload protection the second distance, denoted by reference numeral $s_2$ in FIG. 19, approaches zero; i.e. contact occurs between this clamping section and the fastening anchor.

In the illustrated embodiment the loop-shaped clamping sections 1*d'* and 1*d"* adjacent the torsion legs 1*e'* and 1*e"* extend away from the plane of symmetry 7. In principle, the clamping sections 1*d'* and 1*d"* may extend toward the plane of symmetry 7.

In the illustrated embodiment the retaining plate 4 [sic; 3] is designed as a separate component. The plate 4 [sic; 3] may be a component of a ribbed plate, or may be fixedly connected to the fastening anchor 4.

The illustrated assembly procedure is based on the fact that the sleeper screw 12 is tightened with final torque before the tensioning element 1 is installed. It is also possible for the sleeper screw 12 to not be (completely) tightened until the tensioning element 1 is installed, specifically, in the sleeper unit, for example; i.e. in the preassembled position before the rail is assembled, or in the neutral or final tensioned position after the rail is assembled.

Figure 20:
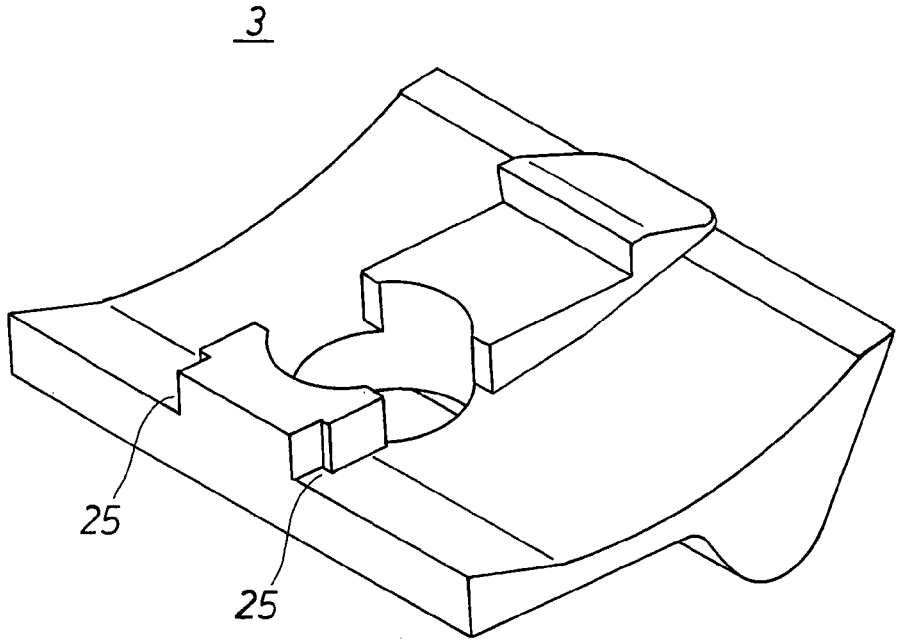
FIG. 20 shows a perspective view of the retaining plate for the rail fastener in a view from above, together with recesses for the ends of the tensioning element.

FIG. 20 shows a perspective view of the retaining plate 3 for the rail fastener, seen from above. The difference from the embodiment according to FIG. 11 is essentially that on the end of the retaining plate 3 facing the rail, recesses 25 are provided for supporting the ends 1*e'* of the clamping section of the tensioning element 1. The recesses 25 are thus used for fixing the tensioning element in place in the assembled state.

Figure 21:
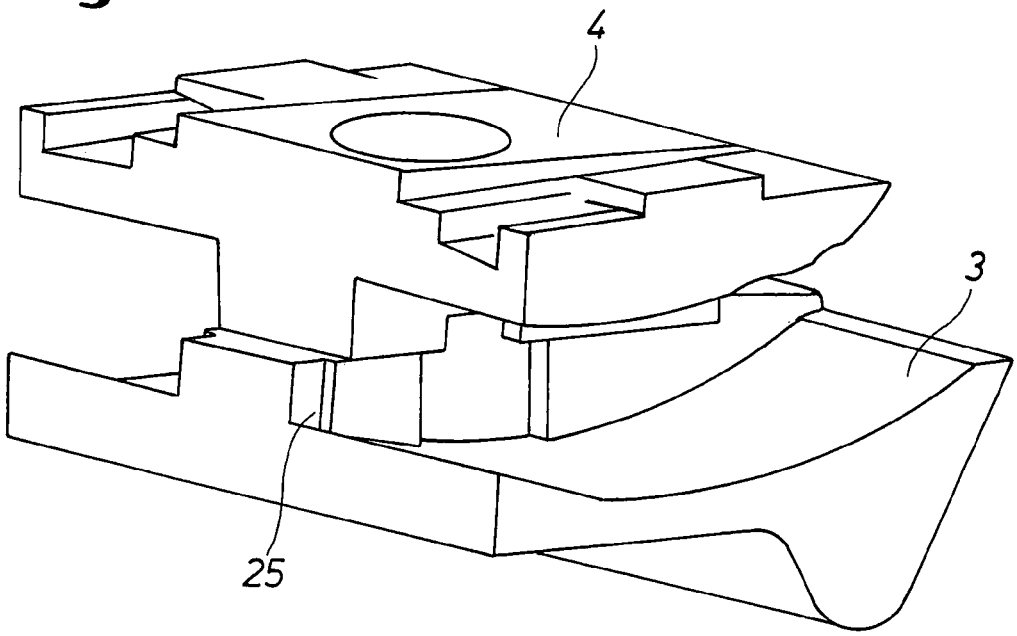
FIG. 21 shows a perspective view of the retaining plate together with the fastening anchor in a one-piece design.

Such recesses 25 may also be provided for an embodiment as illustrated in FIG. 21. In this case the retaining plate 3 and the fastening anchor 4 are designed as one piece in a manner known as such. The rail in this instance is assembled or disassembled using an appropriately shaped fitting or removal claw as an installation tool.

Figure 22:
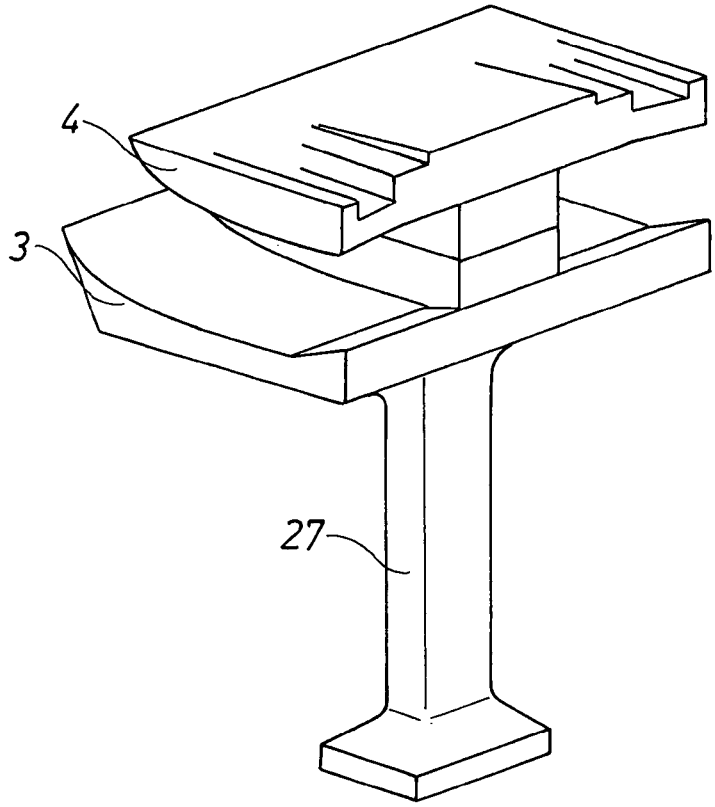
FIG. 22 shows an alternative embodiment of the one-piece design of the retaining plate and fastening anchor, together with a concrete sleeper anchor.

FIG. 22 shows the embodiment according to FIG. 21; i.e. the retaining plate 3 and the fastening anchor 4 are designed as one piece, and here as well a concrete sleeper anchor 27 is provided for anchoring the system. The concrete sleeper anchor 27 may be integrally cast into a concrete sleeper in a form-fit manner.

Figure 23:
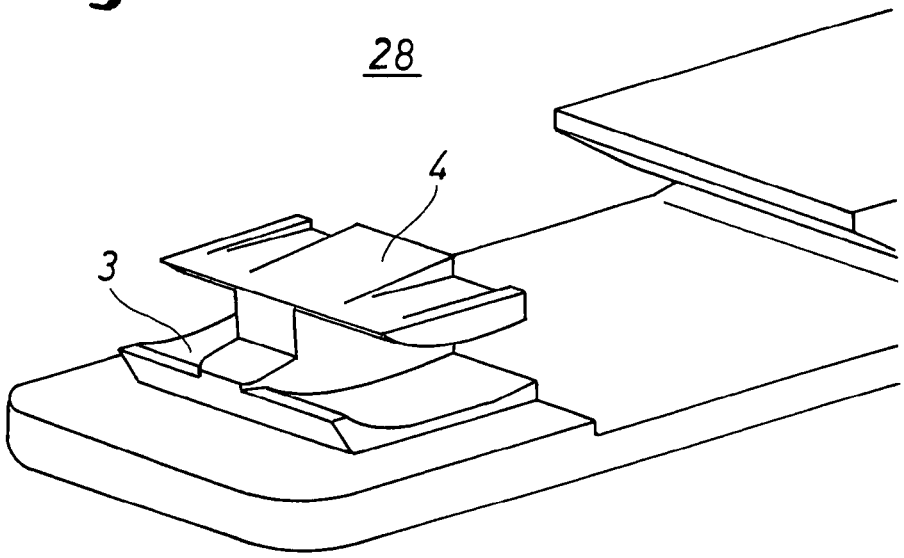
FIG. 23 shows a rail-bed plate having an integrated retaining plate and fastening anchor.
Figure 24:
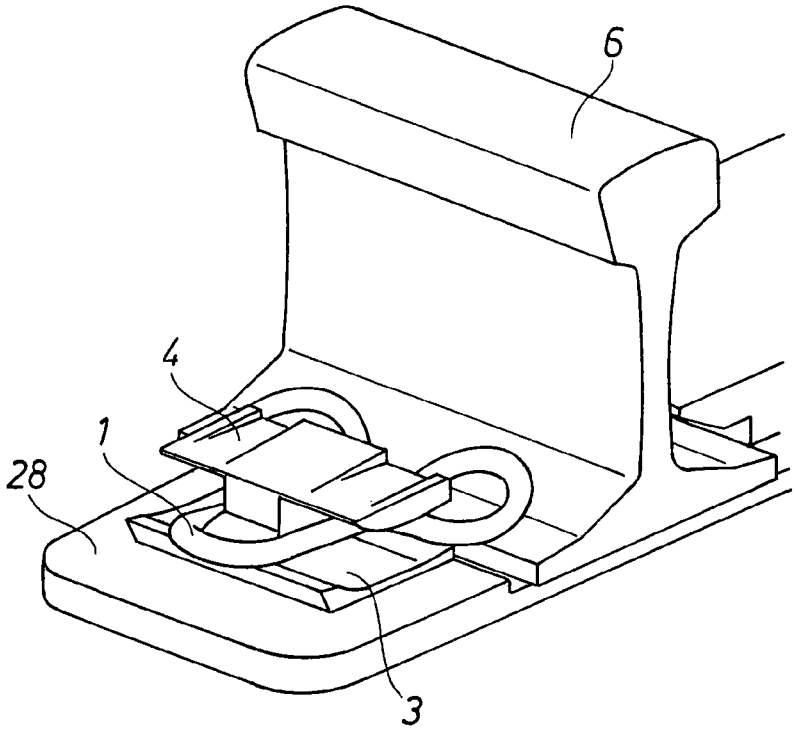
FIG. 24 shows a rail fixed to a rail-bed plate according to FIG. 23 by means of a tensioning element.

FIG. 23 shows a rail-bed plate 28 into which the retaining plate 3 is integrated; the fastening anchor 4 once again is integrally molded as one piece. FIG. 24 shows the manner in which a rail 6 is fixed to the rail-bed plate 28 by means of the tensioning element 1. The retaining plate 3 may be integrated into the rail-bed plate 28 during manufacture of the rail-bed plate, for example, by primary shaping (integral casting). However, the retaining plate may also be welded onto the rail-bed plate 28 as a separate part.

Figure 25:
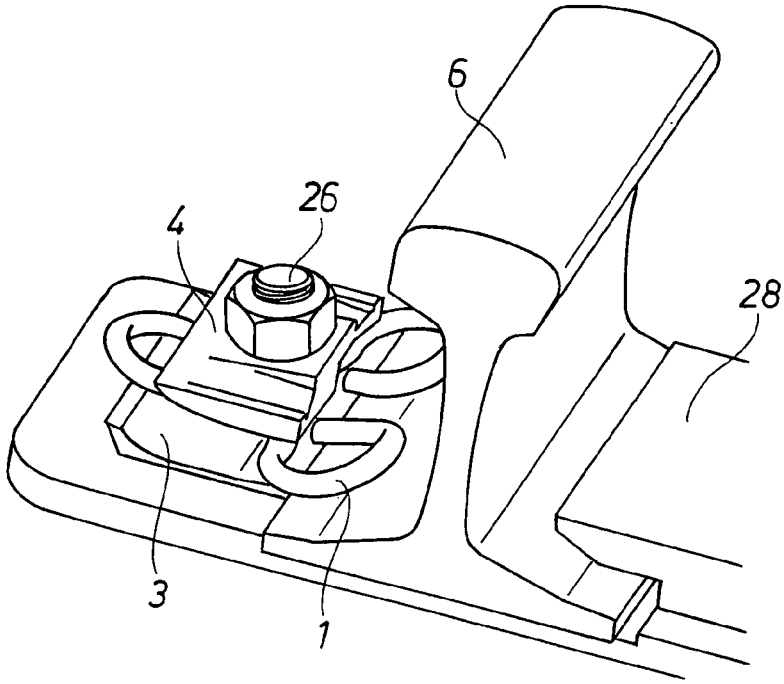
FIG. 25 shows an alternative embodiment to FIG. 24, having a separately attached fastening anchor, the attachment being provided by a hook screw.
Figure 26:
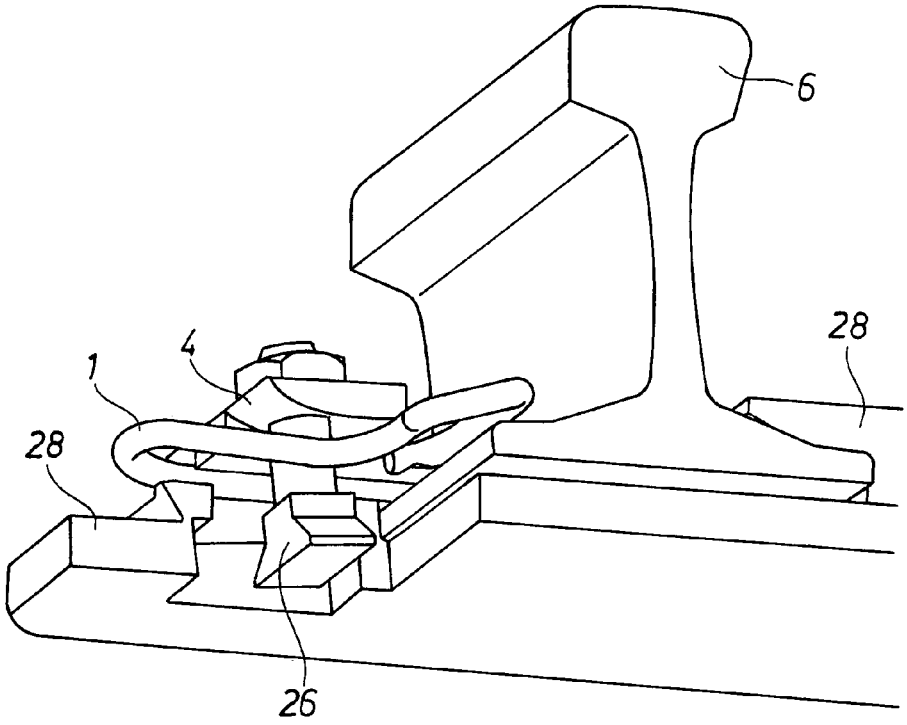
FIG. 26 shows an arrangement according to FIG. 25 in partial section in a view from below.

FIGS. 25 and 26 show an alternative embodiment. In this case, the fastening anchor 4 is designed as a separate part that is connected to the rail-bed plate 28 via a hook screw 26. The tensioning element 1 on account of its very flat shape may also be used as internal jaw or running rail tensioning in the point switch or cross frog region.

Figure 27:
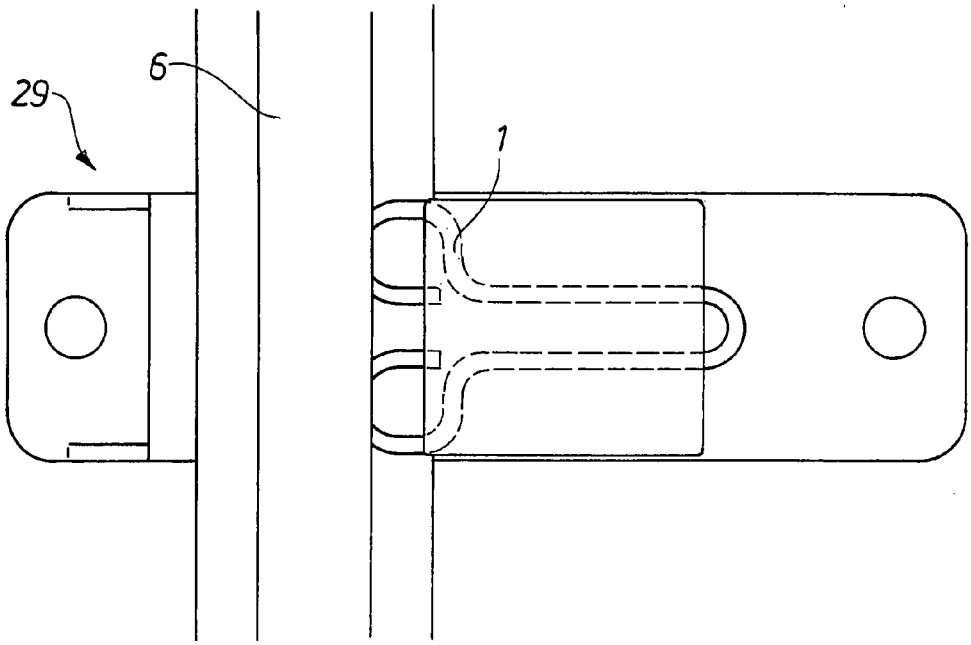
FIG. 27 shows an alternative embodiment of the invention having a slide chair plate for the point switch region.

FIG. 27 shows a slide chair plate 29 for a point switch region, where the rail 6 together with the tensioning element 1 is fixed in place.

Figure 28:
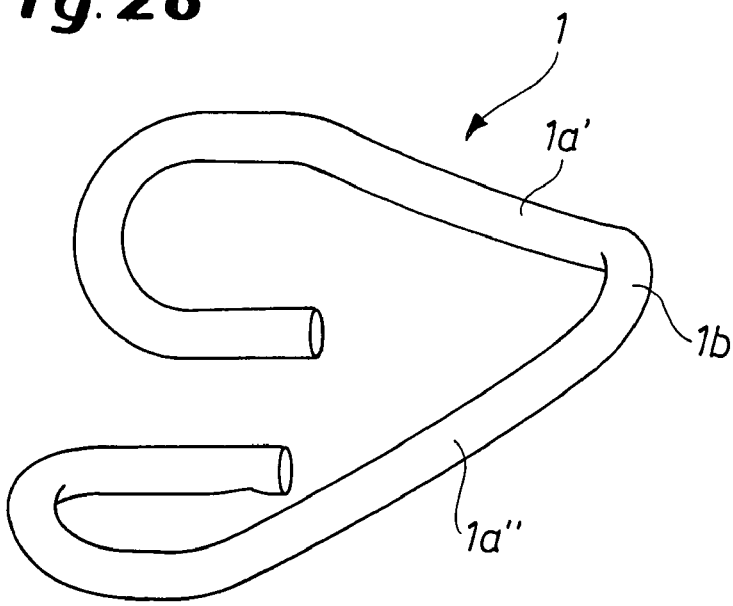
FIG. 28 shows a perspective view of a tensioning element having an alternative design.
Figure 29:
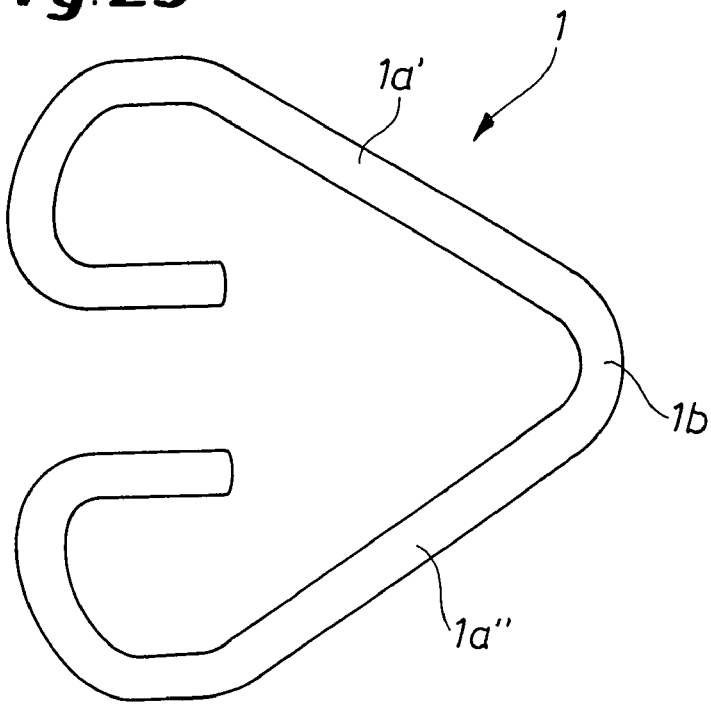
FIG. 29 shows a top view of the tensioning element according to FIG. 28.

One variant of the tensioning element is shown in FIGS. 28 and 29. Here it is seen that the two-torsion legs 1*a*' and 1*a*" are not parallel, but instead form a V shape together with the connecting section 1*b*.

The above-mentioned illustrated embodiments show that all relevant fastener variants of rail tensioning elements in use hitherto may be replaced by a tensioning element of one shape by means of the system according to the invention.

Figure 30:
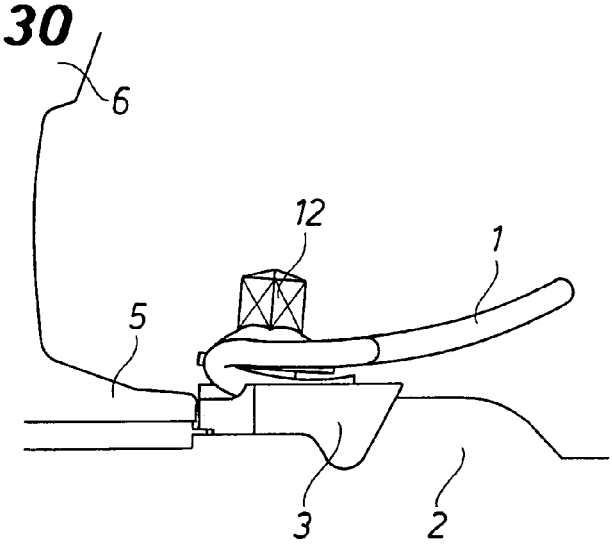
FIG. 30 shows a side view.
Figure 31:
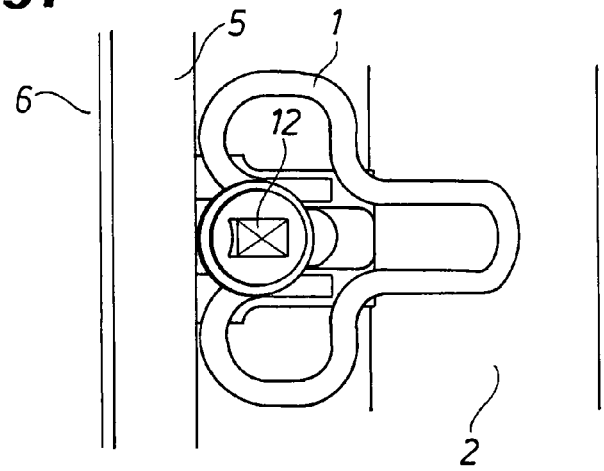
FIG. 31 shows a top view.
Figure 32:
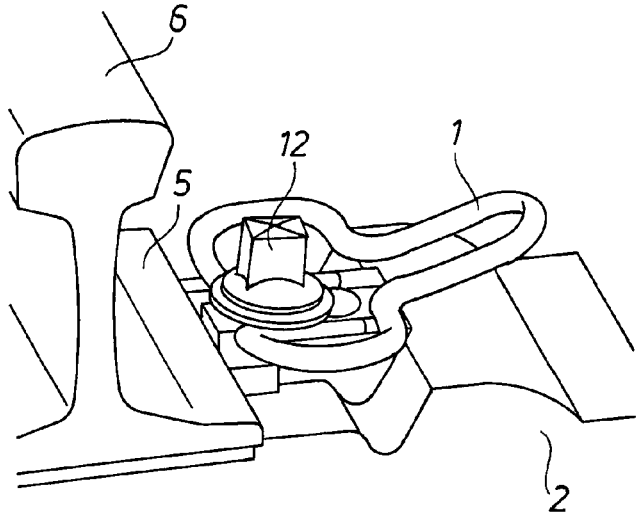
FIG. 32 shows a perspective illustration of a rail fastener in which the fastening anchor is formed by a sleeper screw, specifically, in a preassembled position.
Figure 33:
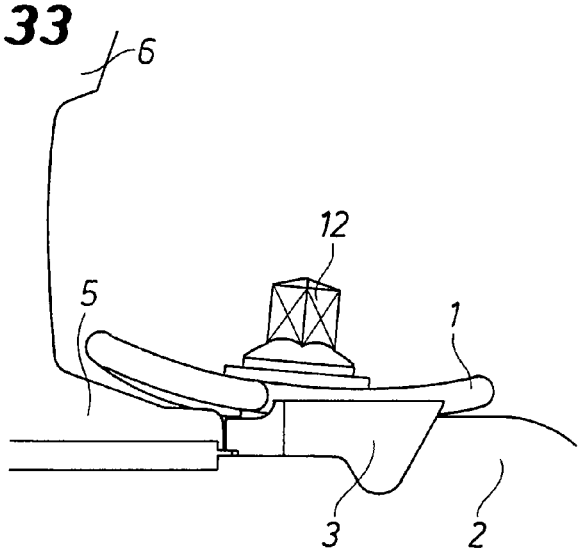
FIG. 33 shows a side view.
Figure 34:
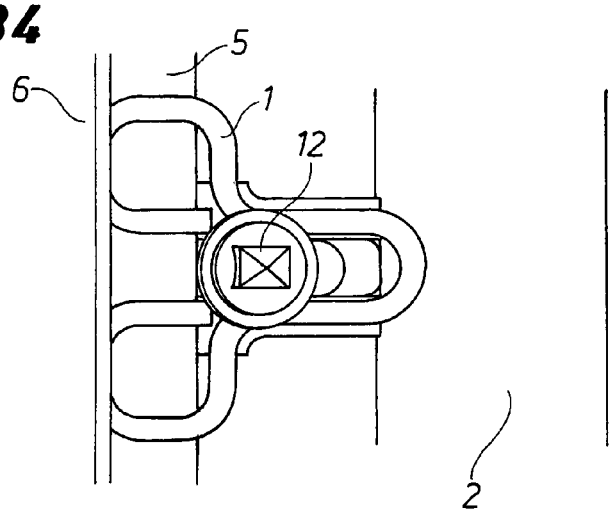
FIG. 34 shows a top view.
Figure 35:
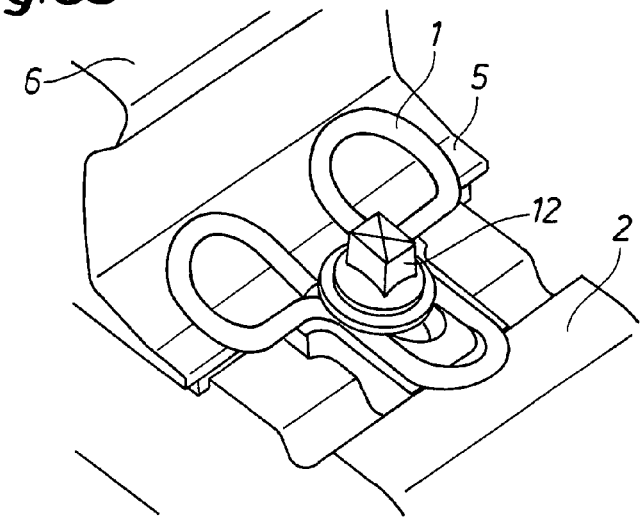
FIG. 35 shows a perspective illustration of the rail fastener according to FIGS. 30 through 32, specifically, in the final assembled position.

In all of the above illustrated embodiments the sleeper screw 12 fixes the fastening anchor 4 in place. However, this is not absolutely necessary. The fastening anchor 4 may be omitted, so that the sleeper screw 12 acts directly on the tensioning element and fixes same in place. To this end, FIGS. 30 through 35 show a corresponding design. The sleeper screw 12 may be connected to or have a washer. In FIGS. 30 through 32 the tensioning element 1 is still in an initial pre-assembled position. In FIGS. 33 through 35 the tensioning element 1 has been brought into its final assembled position. For installation, reference is made to the above description.

Figure 36:
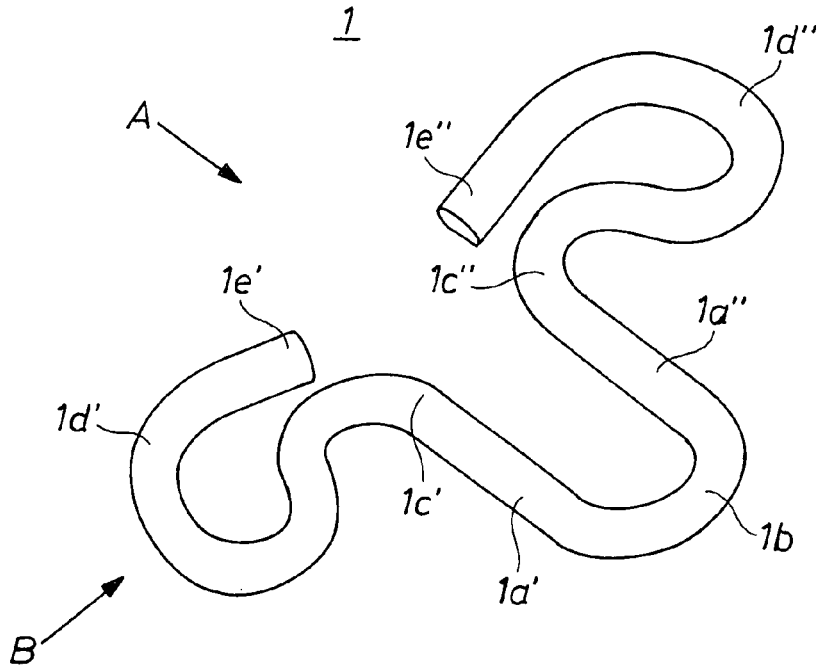
FIG. 36 shows a perspective view of an alternative design of the tensioning element in a view from above.
Figure 37:
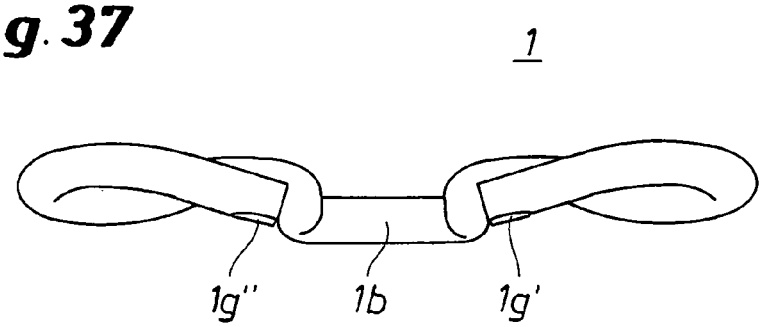
FIG. 37 shows a front view (view A according to FIG. 36) of the tensioning element according to FIG. 36)
Figure 38:
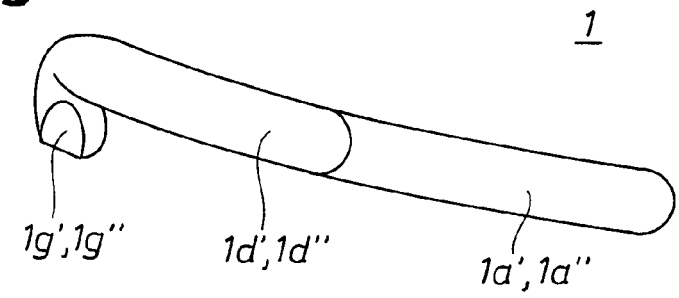
FIG. 38 shows a side view (view B according to FIG. 36) of the tensioning element according to FIG. 36.
Figure 39:
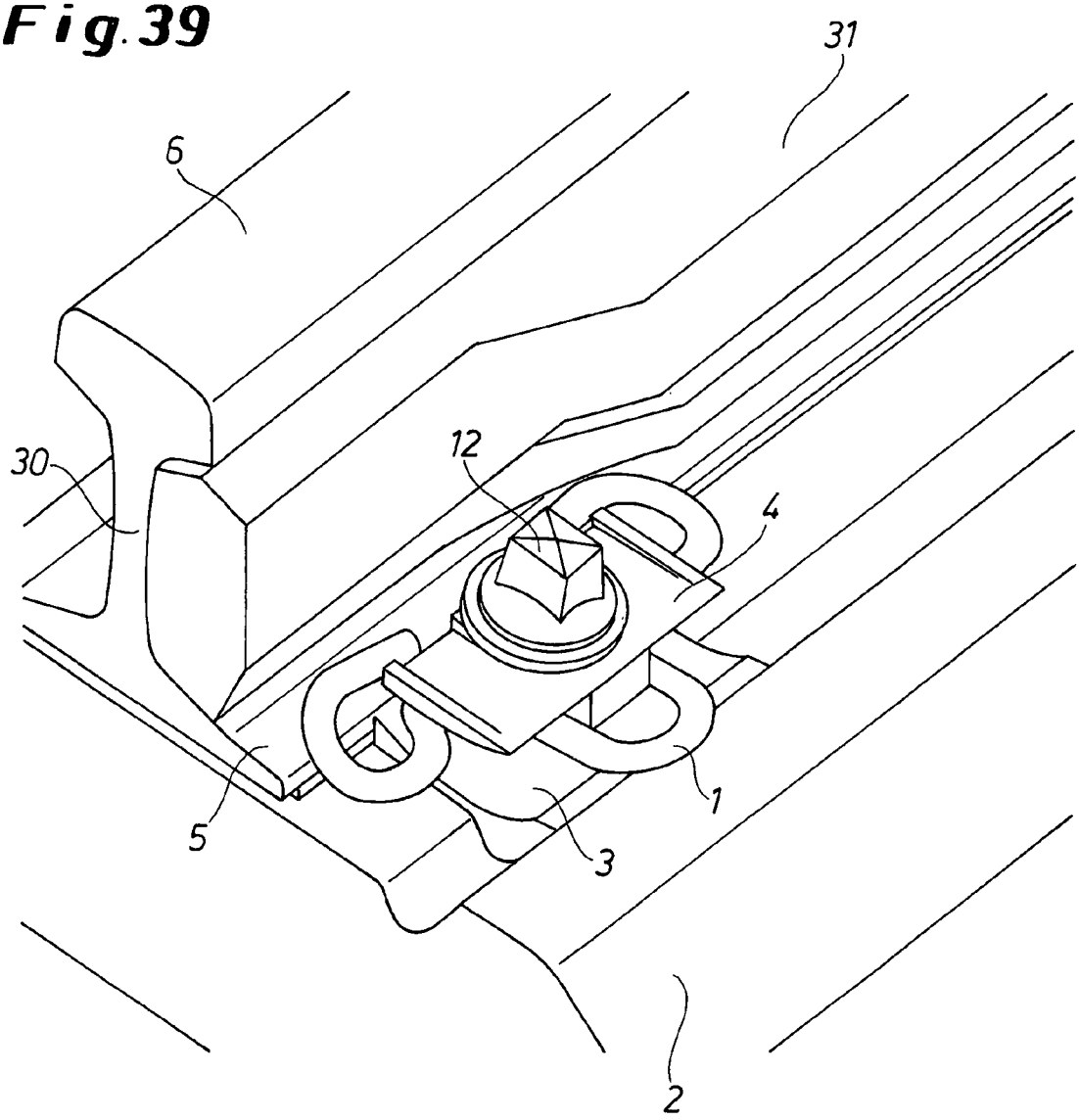
FIG. 39 shows a perspective illustration of the rail fastener together with the tensioning element according to FIGS. 36 through 38, in the final assembled position.

An alternative design of the tensioning element 1 is shown in FIGS. 36 through 38; in FIG. 39 the rail fastener together with this tensioning element 1 is seen in the final assembled position.

The difference between the embodiment of the tensioning element 1 shown by way of example in FIG. 5 and the embodiment shown in FIGS. 36 through 38 is that the loop-shaped clamping sections 1*d*' and 1*d*" have a different shape. Same as for the embodiment according to FIG. 5, the tensioning element 1 first extends from the ends 1*c*' and 1*c*" of the torsion legs 1*a*' and 1*a*", is away from the plane of symmetry 7, but then extends to the rear, away from the rail 6. Only at that point does the tensioning element 1 extend in a loop, once again in the direction of the rail 6 (loop-shaped clamping section 1*d*' and 1*d*"), in order to come to rest on the rail foot 5. This results in an S-shaped curve of the loop-shaped clamping section 1*d*' and 1*d*" from the torsion legs 1*a*' and 1*a*" to the ends 1*e*' and 1*e*" of the clamping sections. In the embodiment according to FIG. 5, the transitions are straight in places (see sections 1*k*' and 1*k*" in FIG. 5).

A further difference in the embodiment illustrated in FIGS. 36 through 38 is that the support surfaces (see, for example, 1*g*' and 1*g*" in FIG. 10) have been altered. In this embodiment, the ends 1*e*' and 1*e*" on the top side of the rail foot are aligned obliquely to a parallel orientation with respect to the longitudinal direction of the rail 6, as shown in FIGS. 36 and 39.

In the embodiment described above according to FIG. 5, the ends 1*e*' and 1*e*" are essentially at right angles to the longitudinal axis of the rail.

In the embodiment according to FIGS. 36 through 39, the support surfaces 1*g*' and 1*g*" at the ends 1*e*' and 1*e*" are slightly flattened and rest on top of the rail foot. This enlarges the support or contact surface between the tensioning element 1 and the rail foot 5, thereby preventing additional wear as the result of migration of the rail 6 in the longitudinal direction.

In the embodiment according to FIGS. 36 through 39, it is seen that a much smaller installation space is present with regard to the distance from the rail bar 30 when, for example, rail stems 31 are built on, as shown in FIG. 39. The embodiment according to FIGS. 36 through 39 therefore represents a preferred embodiment of the invention.

The variant of the tensioning element 1 illustrated in FIGS. 40 through 45 is similar to that of FIGS. 36 through 40. However, in this embodiment the ends 1*e*' and 1*e*" of the clamping section 1*d*' and 1*d*" have a different shape. In this case, the end regions 1*e*' and 1*e*" are curved inward at an angle equal to or greater than 45° (see in particular FIG. 41). The angled section 1*e*' and 1*e*", together with any flattened lower face provided, lies completely on top of the rail foot.

A further modified variant of the tensioning element 1 is shown in FIGS. 46 through 51. In this case, the loop-shaped clamping section 1*d*' and 1*d*" is shortened; in comparison to the embodiments described above, the end region of the clamping section facing the rail 6 has been cut off so that the clamping section has only a simple shape. Such a variant of the invention is appropriate when installation space is very limited. The inventive concept in question nonetheless allows very reliable tensioning of the rail. The installation space may be limited to such an extent, for example as the result of specialized rail stems, that supporting a standard rail fastener would otherwise be impossible.

LIST OF REFERENCE NUMERALS

| | |
|---|---|
| 1 | Tensioning element |
| 1a' | Torsion leg |
| 1a" | Torsion leg |
| 1b | Connecting section |
| 1c' | End of torsion leg |
| 1c" | End of torsion leg |
| 1d' | Loop-shaped clamping section |
| 1d" | Loop-shaped clamping section |
| 1e' | End of clamping section |
| 1e" | End of clamping section |
| 1f' | Straight section |
| 1f" | Straight section |
| 1g' | Cutout |
| 1g" | Cutout |
| 1h' | First contact surface |
| 1h" | First contact surface |
| 1i' | Lateral region |
| 1i" | Lateral region |
| 1k' | Second contact surface |
| 1k" | Second contact surface |
| 2 | Sleeper |
| 3 | Retaining plate |
| 4 | Fastening anchor |
| 5 | Rail foot |
| 6 | Rail |
| 7 | Plane of symmetry |
| 8 | Longitudinal axis |
| 9 | First plane |
| 10 | Second plane |
| 11 | Axis |
| 12 | Sleeper screw |
| 13 | Lower face of fastening anchor |
| 14' | Lateral end region |
| 14" | Lateral end region |
| 15' | Contact surface |
| 15" | Contact surface |
| 16' | Lateral end region |
| 16" | Lateral end region |
| 17' | First channeled locking depression |
| 17" | First channeled locking depression |
| 18' | Second channeled locking depression |
| 18" | Second channeled locking depression |
| 19' | Channeled contact surface |
| 19" | Channeled contact surface |
| 20' | Curved depression |
| 20" | Curved depression |
| 21' | Contact surface |
| 21" | Contact surface |
| 22 | Lower face of retaining plate |

-continued

| | |
|---|---|
| 23 | Projection |
| 24 | Recess in sleeper |
| 25 | Recess |
| 26 | Hook screw |
| 27 | Concrete sleeper anchor |
| 28 | Rail-bed plate |
| 29 | Slide chair plate |
| 30 | Rail bar |
| 31 | Rail stem |
| $\alpha$ | Angle |
| $s_1$ | First distance |
| $s_2$ | Second distance |

The invention claimed is:

1. A friction-fit elastic rail fastener for track systems, comprising a tensioning element made of an elastic material, that in the assembled state is fixed in place between a retaining plate provided on a sleeper and a fastening anchor such that the tensioning element exerts a retention force on the foot of a rail in order to hold the rail in position, the tensioning element being symmetrically aligned with respect to a vertical plane of symmetry that is perpendicular to the longitudinal axis of the rail, wherein the tensioning element has two torsion legs that in the assembled state are at least substantially engaged between the retaining plate and the fastening anchor, the two torsion legs being connected to one another on the side facing away from the rail by means of a connecting section, a loop-shaped clamping section is provided on each end of the torsion leg facing the rail, the clamping section first extends essentially perpendicularly to the vertical plane of symmetry, and then extends in a looped manner until the ends of the clamping section reach the vicinity of the ends of the torsion legs, where they form a support surface on the rail foot, in the non-tensioned state of the tensioning element the torsion legs together with the connecting section lying essentially in a first horizontal plane, and at least a portion of the loop-shaped clamping sections lying in a second horizontal plane, whereby the second horizontal plane is rotated about an axis in relation to the first horizontal plane, the axis extending parallel to the sectional axis of the vertical plane of symmetry containing the first horizontal plane.

2. The rail fastener according to claim 1, in the assembled state of the tensioning element, the second horizontal plane is substantially congruent with the first horizontal plane.

3. The rail fastener according to claim 1 wherein the two torsion legs of the tensioning element are essentially parallel.

4. The rail fastener according to claim 1 wherein the loop-shaped clamping sections in the assembled state of the tensioning element and under normal load on the rail contact the rail foot only at the ends of the clamping sections.

5. The rail fastener according to claim 1 wherein the ends of the clamping sections in the assembled state engage with recesses provided for same in the retaining plate.

6. The rail fastener according to claim 5 wherein the recesses in the retaining plate have locking projections.

7. The rail fastener according to claim 1, wherein the loop-shaped clamping sections first extend from the ends of the torsion legs, essentially perpendicular to the vertical plane of symmetry, and then extend in the direction away from the rail in order to return back to the rail in a curved progression.

8. The rail fastener according to claim 7 wherein the loop-shaped clamping sections have an S-shaped curve, at least in places.

9. The rail fastener according to claim 1 wherein the loop-shaped clamping sections as viewed from above have an essentially circular or oval shape or have a circular or oval section.

10. The rail fastener according to claim 1 wherein the loop-shaped clamping sections adjacent the torsion legs first extend essentially perpendicularly away from the plane of symmetry.

11. The rail fastener according to claim 1, wherein the angle between the first horizontal plane and the second horizontal plane is between 5 degrees and 30 degrees in the non-tensioned state of the tensioning element.

12. The rail fastener according to claim 1 wherein the ends of the loop-shaped clamping sections are designed as straight sections.

13. The rail fastener according to claim 12 wherein the straight sections are parallel.

14. The rail fastener according to claim 1, wherein the ends of the clamping sections have a cutout that is designed as a support surface on the rail foot.

15. The rail fastener according to claim 1 wherein each clamping section has a first contact surface in the lateral region of the clamping section for contacting the rail foot, and during a first overload case for the forces acting on the rail the first contact surface contacts the rail foot.

16. The rail fastener according to claim 15 wherein each clamping section has a second contact surface for contacting the fastening anchor, and during a second, more intense overload case that exceeds the first overload case for the forces acting on the rail the second contact surface contacts the fastening anchor.

17. The rail fastener according to claim 1 wherein the retaining plate is integrated into a rail-bed plate.

18. The rail fastener according to claim 1 wherein the retaining plate and the fastening anchor have a two-piece design.

19. The rail fastener according to claim 18 wherein the retaining plate and the fastening anchor are connected or held together by means of a hook screw.

20. The rail fastener according to claim 19 wherein the fastening anchor has a plate-shaped design and is fixed in place by a sleeper screw.

21. The rail fastener according to claim 1 wherein the retaining plate and the fastening anchor have a one-piece design.

22. The rail fastener according to claim 1
wherein
on its lower face the fastening anchor in its lateral end regions facing the rail has contact surfaces for the loop-shaped clamping sections.

23. The rail fastener according to claim 1
wherein
on its lower face the fastening anchor in its lateral end regions facing away from the rail has a first channeled locking depression in each case for locking the tensioning element in a preassembled position.

24. The rail fastener according to claim 1
wherein
on its lower face the fastening anchor in its lateral end regions facing away from the rail has second channeled locking depressions in each case for locking the tensioning element in a neutral position.

25. The rail fastener according to claim 1
wherein
on its lower face the fastening anchor has two channeled contact surfaces for contacting the torsion legs of the tensioning element in the final assembled state.

26. The rail fastener according to claim 1
wherein
the fastening anchor is formed by the sleeper screw or by a washer connected thereto.

27. The rail fastener according to claim 1
wherein
the retaining plate has two curved depressions, extending perpendicular to the longitudinal axis of the rail, for guiding the tensioning element during installation thereof.

28. The rail fastener according to claim 1
wherein
the retaining plate has two contact surfaces for contacting the tensioning element in its assembled state.

29. The rail fastener according to claim 1
wherein
on its lower face the retaining plate has a projection, extending in the direction of the longitudinal axis of the rail, for engaging with a corresponding recess in the sleeper.

* * * * *